US012089693B2

(12) United States Patent
Kilgore

(10) Patent No.: US 12,089,693 B2
(45) Date of Patent: Sep. 17, 2024

(54) FOOTWEAR ELEMENT WITH LOCATING PEGS AND METHOD OF MANUFACTURING AN ARTICLE OF FOOTWEAR

(71) Applicant: NIKE, Inc., Beaverton, OR (US)

(72) Inventor: Elizabeth A. Kilgore, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 132 days.

(21) Appl. No.: 17/940,090

(22) Filed: Sep. 8, 2022

(65) Prior Publication Data

US 2023/0015860 A1 Jan. 19, 2023

Related U.S. Application Data

(62) Division of application No. 16/689,590, filed on Nov. 20, 2019, now Pat. No. 11,464,287.

(60) Provisional application No. 62/785,963, filed on Dec. 28, 2018.

(51) Int. Cl.
*A43B 21/24* (2006.01)

(52) U.S. Cl.
CPC ..... *A43B 21/24* (2013.01)

(58) Field of Classification Search
None
See application file for complete search history.

(56) References Cited

U.S. PATENT DOCUMENTS

| | | | | |
|---|---|---|---|---|
| 1,174,619 | A | 3/1916 | Scholl | |
| 1,515,086 | A * | 11/1924 | Baluta | A43B 11/00 36/1 |
| 4,608,769 | A | 9/1986 | Sturlaugson | |
| 4,777,705 | A * | 10/1988 | Ingram | A43D 999/00 24/575.1 |
| 4,864,736 | A * | 9/1989 | Bierk | A43B 3/106 36/137 |
| 5,276,983 | A | 1/1994 | Hatfield | |
| 5,839,210 | A | 11/1998 | Bernier et al. | |
| 7,204,043 | B2 * | 4/2007 | Kilgore | A43B 23/042 36/105 |

(Continued)

FOREIGN PATENT DOCUMENTS

| | | | |
|---|---|---|---|
| CN | 104620675 | A | 5/2015 |
| CN | 106572720 | A | 4/2017 |

(Continued)

*Primary Examiner* — Jila M Mohandesi
(74) *Attorney, Agent, or Firm* — Quinn IP Law

(57) ABSTRACT

An article of footwear includes an upper defining apertures spaced apart from one another in a first arrangement. A footwear element has pegs spaced apart from one another in the first arrangement and extending through the apertures in the upper. The pegs are secured at a surface of the upper. A method of manufacturing an article of footwear includes placing a footwear element between an inner layer of an upper and an outer layer of the upper. The footwear element includes at least one peg extending outward toward the outer layer. The method includes inserting the peg through the outer layer so that the peg extends through the outer layer and is exposed at an exterior surface of the outer layer. After inserting the peg of the footwear element through the outer layer of the upper, the peg is secured at the exterior surface of the outer layer.

12 Claims, 11 Drawing Sheets

(56) References Cited

U.S. PATENT DOCUMENTS

| | | | | |
|---|---|---|---|---|
| 7,698,836 | B2 * | 4/2010 | Schmelzer | A43B 23/24 36/137 |
| 8,069,538 | B2 * | 12/2011 | Wilcox | A43C 1/00 24/628 |
| D840,663 | S | 2/2019 | Flanagan et al. | |
| 2002/0066213 | A1 | 6/2002 | Wells | |
| 2002/0133977 | A1 | 9/2002 | Pan | |
| 2003/0070322 | A1 | 4/2003 | Masseron | |
| 2008/0313929 | A1 | 12/2008 | Hoyt | |
| 2009/0293318 | A1 | 12/2009 | Garneau et al. | |
| 2010/0319218 | A1 | 12/2010 | Auger et al. | |
| 2013/0074368 | A1 | 3/2013 | Toraya | |
| 2013/0118035 | A1 | 5/2013 | Segato et al. | |
| 2014/0259295 | A1 | 9/2014 | Guglielmo | |
| 2014/0360051 | A1 | 12/2014 | Coulter et al. | |
| 2017/0055630 | A1 | 3/2017 | Marshall | |
| 2017/0258179 | A1 | 9/2017 | Conant et al. | |

FOREIGN PATENT DOCUMENTS

| | | | |
|---|---|---|---|
| CN | 107404968 | A | 11/2017 |
| CN | 108283341 | A | 7/2018 |
| CN | 114343284 | A | 4/2022 |
| DE | 9412188 | U1 | 9/1994 |
| JP | 2003210206 | A | 7/2003 |
| JP | 5157019 | B2 | 3/2013 |
| KR | 20090093548 | A | 9/2009 |
| TW | M547871 | U | 9/2017 |

* cited by examiner

FOOTWEAR ELEMENT WITH LOCATING PEGS AND METHOD OF MANUFACTURING AN ARTICLE OF FOOTWEAR

CROSS-REFERENCE TO RELATED APPLICATION

This application is a divisional of U.S. patent application Ser. No. 16/689,590, filed Nov. 20, 2019, which claims the benefit of priority to U.S. Provisional Application No. 62/785,963, filed Dec. 28, 2018, and both of which are hereby incorporated by reference in their entirety.

TECHNICAL FIELD

The present disclosure generally includes an article of footwear, a method of manufacturing an article of footwear, and a footwear element for an article of footwear.

BACKGROUND

Traditionally, placing footwear on a foot often requires the use of one or both hands to stretch the ankle opening of a footwear upper, and hold the rear portion during foot insertion, especially in the case of a relatively soft upper and/or footwear that does not have a heel counter.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
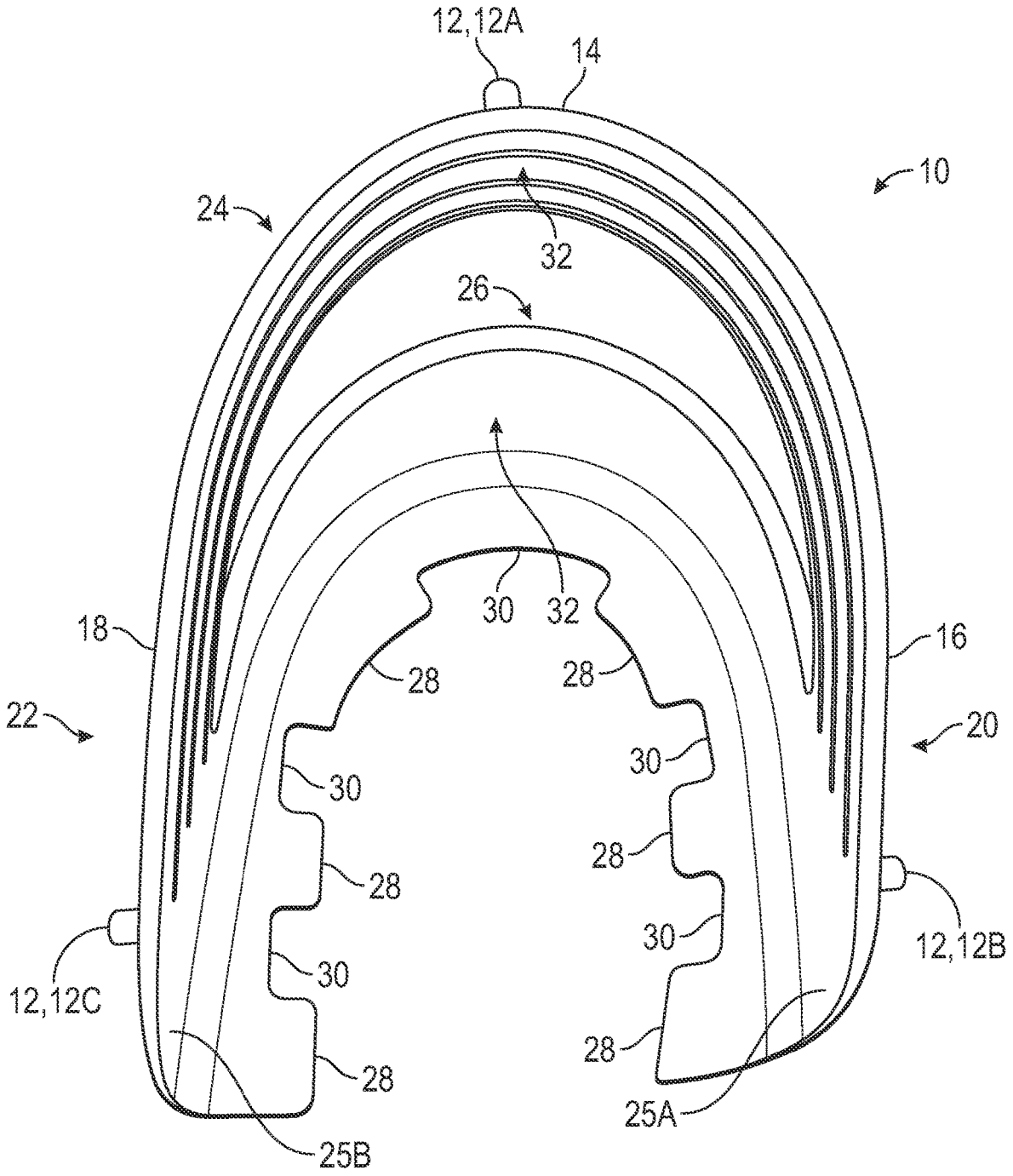
FIG. 1 is a front perspective view of a heel support device.

The present disclosure generally relates to a footwear element, such as a heel support device or other elastically-deformable structural member, and article of footwear that includes the footwear element, and a method of manufacturing the article of footwear. The footwear element and a footwear upper may have complementary locating features as described herein that enable precise positioning of the footwear element relative to the upper. Additionally, the features of the footwear element serve to secure the footwear element at the exterior of the upper, and the method of manufacturing the article of footwear enables aesthetic aspects of these features to be customized.

In an example, an article of footwear may comprise an upper defining apertures spaced apart from one another in a first arrangement. A footwear element may include pegs spaced apart from one another in the first arrangement and extending through the apertures in the upper. The pegs may be secured at an exterior side of the upper.

In one or more implementations, the upper may include an inner layer and an outer layer and may define a foot-receiving cavity inward of the inner layer. The apertures may extend through the outer layer. The footwear element may be disposed between the inner layer and the outer layer. The inner layer may be disposed between the footwear element and the foot-receiving cavity.

In one or more configurations, each of the pegs may include a shaft portion and a head portion of unitary, integral construction with the shaft portion. The shaft portion may extend through one of the apertures of the upper. The head portion may be bonded at an exterior surface of the upper.

In an aspect, the head portion may depict at least one of a number, a letter, a symbol, a logo, an object, or a design, or may have a specific surface texture, or may be a specific color. Additionally, the pegs need not be the same, as one or more of the pegs may depict a different number, letter, symbol, logo, object, design, surface texture, or specific color than one or more of the other pegs.

In another aspect, the footwear element may be a heel support device connected to a heel region of the upper, and may include a center portion, a medial portion extending forwardly from the center portion at a medial side of the heel support device, and a lateral portion extending forwardly from the center portion at a lateral side of the heel support device. A first of the pegs may be integral with and extend outward from the center portion. A second of the pegs may be integral with and extend outward from the medial portion. A third of the pegs may be integral with and extend outward from the lateral portion.

In one or more implementations, the heel support device, including the center portion, the medial portion, the lateral portion, and the pegs, may be a unitary, one-piece component.

In one or more configurations, the heel support device may include a control bar and a base. The control bar may have a center segment, a medial side arm extending downwardly and forwardly from the center segment at the medial side of the heel support device, and a lateral side arm extending downwardly and forwardly from the center segment at the lateral side of the heel support device. The base may have a medial base arm connected to the medial side arm of the control bar, a lateral base arm connected to the lateral side arm of the control bar, and a center segment connecting the medial base arm to the lateral base arm. The first of the pegs may extend outward from the center segment of the control bar. The second of the pegs may extend outward from the medial side arm of the control bar or from the medial base arm. A third of the pegs may extend outward from the lateral side arm of the control bar or from the lateral base arm.

In an aspect, the control bar may include a series of slats. Each slat of the series of slats may extend in the center segment, the medial side arm, and the lateral side arm. The first of the pegs may extend outward from one slat of the series of slats. A fourth of the pegs may extend outward from the center segment of the base.

In another aspect, the control bar may be biased to an unloaded position and may elastically bend under an applied force to a loaded position in which the control bar is closer to the base than in the unloaded position, storing potential energy that returns the control bar to the unloaded position upon removal of the applied force. The upper may be connected to move with the control bar by the first of the pegs. An ankle opening of the upper may extend further rearward and downward when the control bar is in the loaded position than when the control bar is in the unloaded position. The heel support device stores potential energy, such as elastic energy and/or spring energy, which returns the control bar to the unloaded position upon removal of the applied load. As used herein, elastic bending may also be referred to as resilient bending, and entails resilient deformation or elastic deformation. For example, a foot can press down on the control bar, and slip into the foot-receiving cavity of an attached footwear upper without requiring the use of a hand or of any tool to adjust the upper for foot entry.

In an example, a method of manufacturing an article of footwear may comprise placing a footwear element between an inner layer of an upper and an outer layer of the upper. The footwear element may include at least one peg extending outward toward the outer layer. The method of manufacturing may include inserting the at least one peg of the footwear element through the outer layer of the upper so that the at least one peg extends through the outer layer and is exposed at an exterior surface of the outer layer. The method of manufacturing may further include securing the at least one peg at the exterior surface of the outer layer after inserting the at least one peg through the outer layer of the upper.

In one or more configurations, the at least one peg may include multiple pegs, and the outer layer of the upper may include multiple apertures. The pegs may be spaced apart from one another in a first arrangement. The apertures may also be spaced apart from one another in the first arrangement so that the apertures align with the pegs.

In one or more implementations, securing the at least one peg at the exterior surface of the outer layer of the upper may comprise bonding the at least one peg to the exterior surface of the outer layer. In an aspect, bonding the at least one peg to the exterior surface of the outer layer may comprise pressing a heating tool against an end of the at least one peg at the exterior surface of the outer layer to melt the end against the exterior surface of the outer layer. For example, the heating tool may be an ultrasonic heating tool.

In an aspect, the heating tool may have a mold surface that shapes a head portion of the at least one peg at the exterior surface of the outer layer, and pressing the heating tool to melt the end may create the head. The method of manufacturing may further comprise selecting the heating tool from a group of heating tools each having a mold surface with a different shape depicting at least one of a number, a letter, a symbol, a logo, an object, or a design, or with a different surface texture. In another aspect, selecting the heating tool may be in response to a request for a specific shape or a specific surface texture of the head. The mold surface of the heating tool selected may have the specific shape. For example, a customer may request a specific shape or surface texture in order to customize their footwear. The customer may also request a head of a specific color, and the device used may be of a material having the specific color.

In a further aspect, placing the footwear element between the inner layer of the upper and the outer layer of the upper may be through an opening between the inner layer and the outer layer. The method of manufacturing may further comprise, after placing the footwear element between the inner layer of the upper and the outer layer of the upper, closing the opening.

In an example, a heel support device may be configured to surround a portion of a foot-receiving cavity at a heel region of an article of footwear. The heel support device may comprise a control bar and a base. The control bar may have a center segment, a medial side arm extending downwardly and forwardly from the center segment at a medial side of the heel support device, and a lateral side arm extending downwardly and forwardly from the center segment at a lateral side of the heel support device. The base may have a medial base arm connected to the medial side arm of the control bar, a lateral base arm connected to the lateral side arm of the control bar, and a center segment connecting the medial base arm to the lateral base arm. The heel support device may include pegs extending outward from the heel support device. A first of the pegs may extend outward from the center segment of the control bar, a second of the pegs may extend outward from the medial side arm of the control bar or from the medial base arm, and a third of the pegs may extend outward from the lateral side arm of the control bar or from the lateral base arm. The control bar may be biased to an unstressed position and may elastically deform toward the base under an applied force to a loaded position. The heel support device may store potential energy that returns the control bar to the unstressed position upon removal of the applied force.

In one or more configurations of the heel support device, the control bar may include a series of slats. Each slat of the series of slats may extend in the center segment, the medial side arm, and the lateral side arm. The first of the pegs may extend outward from one slat of the series of slats. In an aspect, a fourth of the pegs may extend outward from the center segment of the base. In a further aspect, the heel support device, including the control bar, the base, and the pegs, may be a unitary, one-piece component.

In an example, an article of footwear comprises an upper comprising at least a first layer of a first material having a first melt temperature, the first layer having an inner surface facing a foot-receiving cavity formed by the upper and having an outer surface facing away from the foot-receiving cavity. The article of footwear also comprises a footwear element including a body and at least one peg. The at least one peg has a stem and a head. A first end of the stem is joined to the body, and the head is disposed at a second end of the stem. The body is disposed proximate to the inner surface of the first layer, and the head is disposed proximate to the outer surface of the first layer. The at least one peg comprises a second material having a second melt temperature lower than the first melt temperature.

In one or more implementations, the stem and the head are of unitary, integral construction, and the stem also comprises the second material. Still further, the head, the stem, and the body may be of unitary, integral construction, with the stem and the body also comprising the second material. In an aspect, the head may depict at least one of a number, a letter, a symbol, a logo, an object, or a design In one of more configurations, the first layer of the upper may define apertures spaced apart from one another in a first arrangement. The at least one peg may comprise multiple pegs spaced apart from one another in the first arrangement and extending through the apertures in the upper.

In an aspect, the first layer may be an outer layer of the upper, and the upper may further including an inner layer with the foot-receiving cavity inward of the inner layer. The apertures may extend through the outer layer. The footwear element may be disposed between the inner layer and the outer layer. The inner layer may be disposed between the footwear element and the foot-receiving cavity.

In another aspect, the footwear element may be a heel support device disposed at a heel region of the upper. The body may comprise a center portion, a medial portion extending forwardly from the center portion at a medial side of the heel support device, and a lateral portion extending forwardly from the center portion at a lateral side of the heel support device. A first of the pegs may be integral with and extend outward from the center portion, a second of the pegs may be integral with and extend outward from the medial portion, and a third of the pegs may be integral with and extend outward from the lateral portion.

In another aspect, the heel support device, including the center portion, the medial portion, the lateral portion, and the pegs, may be a unitary, one-piece component.

In one or more configurations, the footwear element may be a heel support device connected to a heel region of the upper. The body of the heel support device may include a control bar and a base. The control bar may have a center segment, a medial side arm extending downwardly and forwardly from the center segment at the medial side of the heel support device, and a lateral side arm extending downwardly and forwardly from the center segment at the lateral side of the heel support device. The base may have a medial base arm connected to the medial side arm of the control bar, a lateral base arm connected to the lateral side arm of the control bar, and a center segment connecting the medial base arm to the lateral base arm. A first of the pegs may extend outward from the center segment of the control bar, a second of the pegs may extend outward from the medial side arm of the control bar or from the medial base arm, and a third of the pegs may extend outward from the lateral side arm of the control bar or from the lateral base arm.

In one or more implementations, the control bar may include a series of slats. Each slat of the series of slats may extend in the center segment, the medial side arm, and the lateral side arm. The first of the pegs may extend outward from one slat of the series of slats, and a fourth of the pegs may extend outward from the center segment of the base. The control bar may be biased to an unloaded position and may elastically bend under an applied force to a loaded position in which the control bar is closer to the base than in the unloaded position, storing potential energy that returns the control bar to the unloaded position upon removal of the applied force. The upper may be connected to move with the control bar by the first of the pegs. An ankle opening of the upper may extend further rearward and downward when the control bar is in the loaded position than when the control bar is in the unloaded position.

In an example, an article of footwear comprises an upper having at least a first layer of a pliable material disposed about at least a portion of a foot-receiving cavity. The article of footwear further comprises an elastically deformable structural member disposed at a first side of the first layer proximate the foot-receiving cavity. The article of footwear also comprises a peg extending from a first end joined with the elastically deformable structural member to a distal end spaced apart from the elastically deformable structural member. The peg extends through an aperture provided in the first layer and to a second side of the first layer. A broadened head is provided at the distal end of the peg. A width of the broadened head is greater than a width of the aperture.

In an example, a method of manufacturing an article of footwear comprises obtaining a footwear element having a peg comprising a stem, and causing the stem to extend through a first layer of an upper and protrude from the first layer. The method of manufacturing also comprises forming a head at one end of the stem after the stem protrudes from the first layer.

In one or more implementations, forming the head bonds the head to the first layer. Forming the head may comprises melting the one end of the stem. Forming the head may comprise pressing a heating tool against the one end of the stem to melt the one end.

In one or more configurations, the heating tool may have a mold surface that shapes the head, and the method of manufacturing may further comprise selecting the heating tool from a group of heating tools each having a mold surface with a different shape depicting at least one of a number, a letter, a symbol, a logo, an object, or a design, or with a different surface texture.

In an aspect, selecting the heating tool may be in response to a request for a specific shape or a specific surface texture of the head. The mold surface of the heating tool selected may have the specific shape or the specific surface texture requested.

In another aspect, the head may protrude through an aperture in the first layer, and the head may be larger than the aperture.

In one or more implementations, the upper may further comprise a second layer, and the method may further comprise placing the footwear element between the first layer and the second layer prior to forming the head.

In an aspect, placing the footwear element between the first layer and the second layer of the upper may be through an opening between the first layer and the second layer. The method of manufacturing may further comprise, after placing the footwear element between the first layer and the second layer, closing the opening.

The above features and advantages and other features and advantages of the present teachings are readily apparent from the following detailed description of the modes for carrying out the present teachings when taken in connection with the accompanying drawings.

Referring to the drawings, wherein like reference numbers refer to like components, FIG. 1 shows a footwear element 10 that is an elastically deformable structural member of an article of footwear. The footwear element 10 shown and described herein is a heel support device, and may be referred to herein as such. In other implementations, other footwear elements may be configured and/or manufactured according to the teachings herein. The heel support device 10 eases foot entry into an article of footwear as described herein. The heel support device 10 is also referred to herein as the device 10, or as a heel spring device 10. The device 10 includes pegs 12 that serve as locating features for accurately positioning the device 10 relative to an upper during manufacturing, as described herein. In the embodiment shown, there are four pegs 12, only three of which are visible in FIG. 1.

The heel support device 10 has a center segment 14, a medial side arm 16, and a lateral side arm 18. The medial side arm 16 extends downwardly and forwardly from the center segment 14 at a medial side 20 of the heel support device 10. The lateral side arm 18 extends downwardly and forwardly from the center segment 14 at a lateral side 22 of the heel support device 10. Together, the center segment 14, the medial side arm 16, and the lateral side arm 18 are referred to as a control bar 24.

The base 26 supports the control bar 24 and is connected to the control bar 24 at a resiliently bendable junction 25A, 25B. The base 26 is continuous and extends between and connects to the medial side arm 16 and the lateral side arm 18. The base 26 is continuous, in that it is without breaks or connections through other components in extending from the medial side arm 16 to the lateral side arm 18.

The base 26 has an inner edge 28 that is castellated. Stated differently, the inner edge 28 includes a series of notches 30. The base 26 has a cupped shape and extends to the inner edge 28 under the foot. More specifically, the device 10 has an inner surface 32 with a first concavity from the medial side arm to the lateral side arm and a second concavity from an upper extent of the center segment 14 to the inner edge 28 of the base 26. The notches 30 at the inner edge 28 provide the feel of a more moderated change in stiffness from a relatively hard and stiff heel support device 10 to relatively soft underlying sole structure while still providing sufficient bonding area of the lower side of the base to a sole structure or to a strobel.

The base 26 has a medial base arm 34 (best shown in FIG. 3) connected to the medial side arm 16 of the control bar 24, and a lateral base arm 36 connected to the lateral side arm 18 of the control bar 24. The base 26 also includes a center segment 38 that connects the medial base arm 34 to the lateral base arm 36. The center segment 38, the medial base arm 34, and the lateral base arm 36 of the base 26 are disposed in a common plane. The common plane is parallel with a horizontal surface when the base 26 of the device 10 rests on a horizontal surface. The medial base arm 34 is spaced apart from the lateral base arm 36 and both extend from the center segment 38 of the base 26.

The center segments 14, 38 may be referred to together as a center portion of the device 10, the medial side arm 16 and the medial base arm 34 may be referred to together as the medial portion of the device 10, and the lateral side arm 18 and the lateral base arm 36 may be referred to together as the lateral portion of the device 10. In the embodiment shown herein, the device 10 is configured as a heel spring device with the control bar 24 movable toward the base 26, and is configured to facilitate easy foot entry and removal from an article of footwear as discussed herein. In other embodiments, the device may be a U-shaped heel counter without a control bar or a base, functioning mainly for support in the heel region, and need not be for facilitating easy access. In still other embodiments, instead of a heel support device, the footwear element 10 may be an elastically deformable structural member that may facilitate easy access into the foot-receiving cavity, or may have a structural purpose different than facilitating easy access.

The junction 25A, 25B includes a first joint 25A at which the base 26 and the medial side arm 16 connect, and a second joint 25B at which the base 26 and the lateral side arm 18 connect. The first joint 25A is the connection of the medial base arm 34 to the medial side arm 16. The second joint 25B is the connection of the lateral base arm 36 to the lateral side arm 18.

The control bar 24 has an arced shape from the first joint 25A to the second joint 25B. Similarly, the base 26 has an arced shape from the first joint 25A to the second joint 25B. With this arrangement, the control bar 24 and the base 26 are configured as a full elliptical leaf spring as described herein, and the device 10 may be referred to as a heel spring device.

The control bar 24 includes a series of slats 24A, 24B, 24C, and 24D. Each slat 24A, 24B, 24C, and 24D of the series of slats extends in the center segment 14, the medial side arm 16, and the lateral side arm 18. Accordingly, each slat 24A, 24B, 24C, and 24D is a portion of the center segment 14, of the medial side arm 16 extending from the center segment 14 to the base 26 at the medial side 20, and of the lateral side arm 18 extending from the center segment 14 to the base 26 at the lateral side 22.

Figure 2:
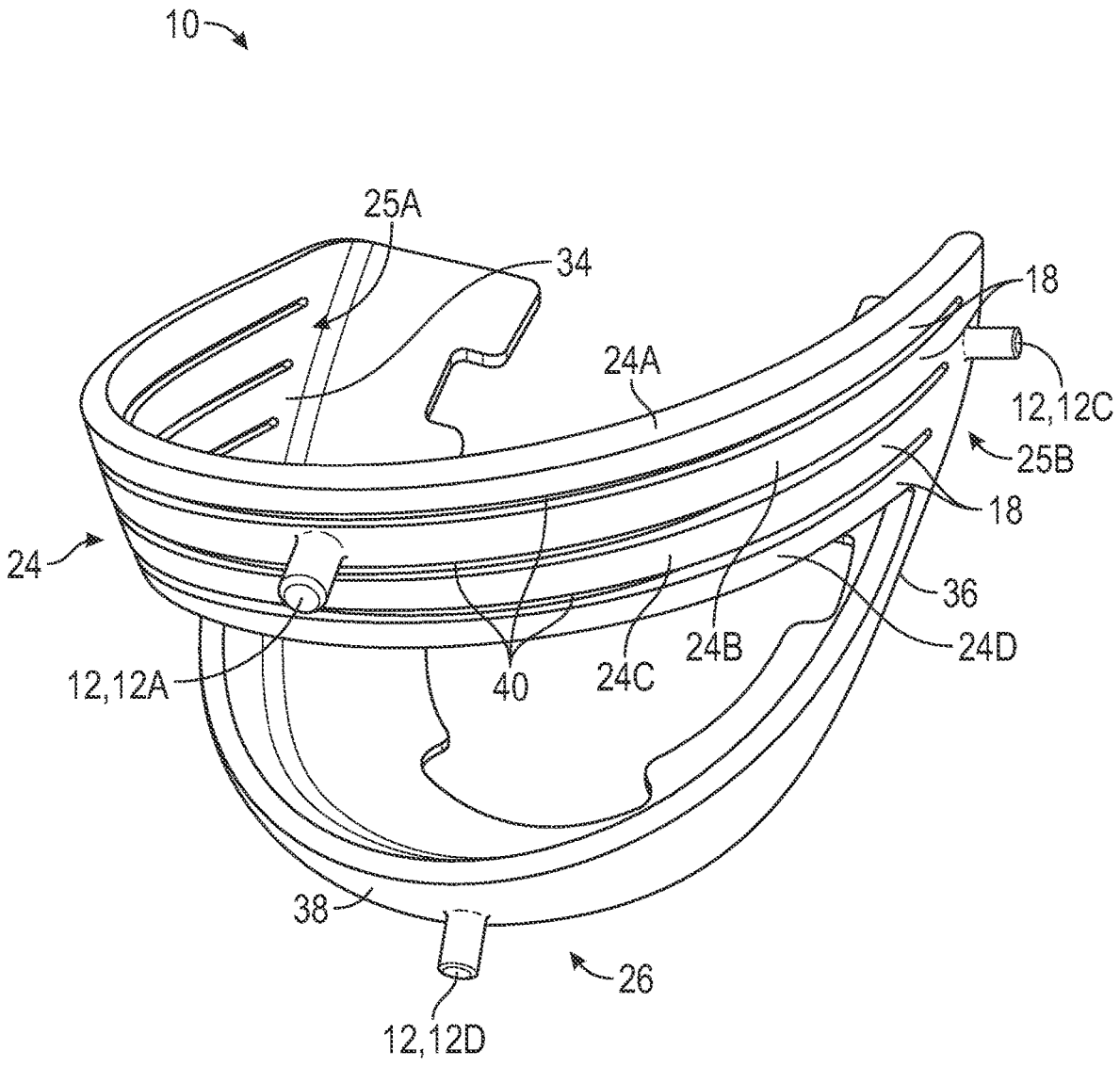
FIG. 2 is a lateral perspective view of the heel support device.
Figure 3:
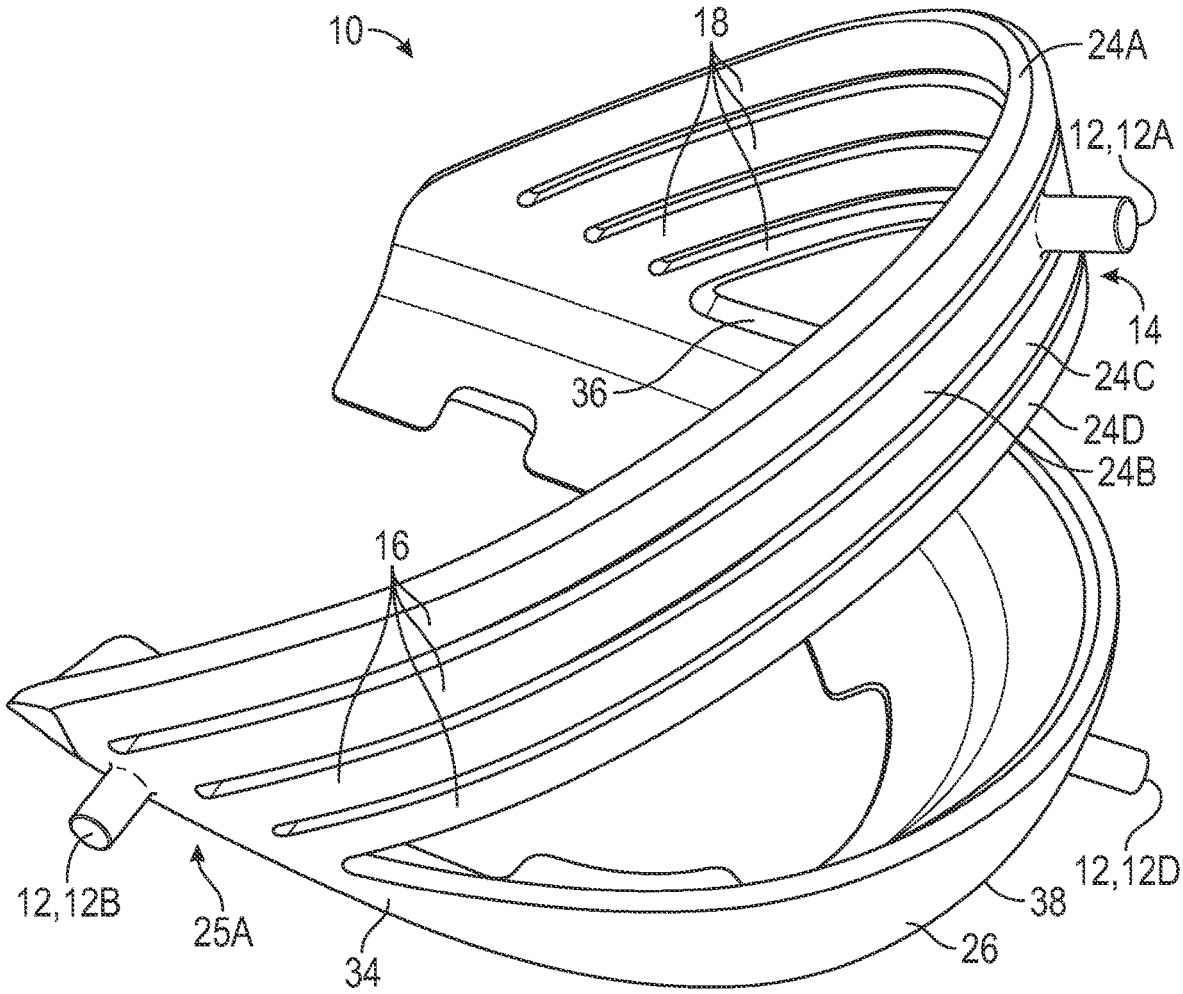
FIG. 3 is a medial perspective view of the heel support device.

The control bar 24 defines slots 40 extending between the slats 24A, 24B, 24C, and 24D. The slats 24A, 24B, 24C, and 24D are spaced apart from one another by the slots 40 when the control bar 24 is in the unloaded position shown in FIG. 2. The pegs 12 are spaced apart from one another in a first arrangement. The first arrangement is the relative spacing of the pegs 12 (e.g., the distances between the different pegs 12) as shown in FIGS. 1-3, when the device 10 is in the unloaded position. A first peg 12A is integral with and extends outward from one of the slats 24B at the center segment 14. A second peg 12B is integral with and extends outward from the medial portion. The second peg 12B is shown extending outward from the medial base arm 34. In another embodiment, the second peg 12B could be integral with and extend from one of the slats 24A, 24B, 24C, 24D at the medial side arm 16. A third peg 12C is integral with and extends outward from the lateral portion. The third peg 12C is shown extending outward from the lateral base arm 36. In another embodiment, the third peg 12C could be integral with and extend from one of the slats 24A, 24B, 24C, 24D at the lateral side arm 18. A fourth peg 12D extends outward from the center segment 38 of the base 26.

In FIGS. 1-3, the device 10 is shown prior to final assembly in an article of footwear. At the stage shown prior to final assembly, the pegs 12 are generally straight, cylindrical shafts extending at a constant width to terminal ends. Although four pegs 12 are shown, the device 10 may have fewer or more pegs. Providing at least two spaced pegs 12 provides some ability to accurately position the device 10 relative to a footwear upper during manufacturing. By providing four pegs 12, with one peg 12A on the control bar 24, one peg 12D on the base 26, one peg 12B on the medial base arm 34, and one peg 12C on the lateral base arm 36, the four pegs 12 are arranged in a first arrangement that is four spaced points not all of which are coplanar. This more accurately positions the device 10 relative to the upper during manufacturing than would only two or three pegs.

Additionally, the heel support device 10, including the control bar 24, the base 26, and the pegs 12, is a unitary, one-piece component, with the control bar 24, the base 26, and the pegs 12 all of a common material. For example, the device 10 may be injection molded as a single, unitary, one-piece component. The control bar 24 and the base 26 may be referred to as the body 24, 26 of the device 10, and the pegs 12 are joined to the body 24, 26, such as by being integral with the body 24, 26. The material of the device 10, and particularly of the body 24, 26, is selected to provide the ability to elastically deform by elastic bending as described, and store potential energy, such as elastic energy, that returns the device 10 to the unloaded position. The material of heads of the pegs 12, which may be the same material as the body 24, 26, is selected to provide a melt temperature lower than a melt temperature of a footwear layer at which the heads of the pegs are disposed, or at least the head of one of the pegs is disposed, as discussed herein. Example materials for the device 10 include plastics (such as thermoplastics), composites, and nylon. Another example material for the device 10 is a polyether block amide such as PEBAX® available from Arkema, Inc. in King of Prussia, Pennsylvania USA. Another example material for the device 10 is a fiberglass reinforced polyamide. An example fiberglass reinforced polyamide is RISLAN® BZM 7 0 TL available from Arkema, Inc. in King of Prussia, Pennsylvania USA. Such a fiberglass reinforced polyamide may have a density of 1.07 grams per cubic centimeter under ISO 1183 test method, an instantaneous hardness of 75 on a Shore D scale under ISO 868 test method, a tensile modulus of 1800 MPa under ISO 527 test method (with samples conditioned 15 days at 23 degrees Celsius with 50% relative humidity), and a flexural modulus of 1500 MPa under ISO 178 test method (with samples conditioned 15 days at 23 degrees Celsius with 50% relative humidity). Another example material for the device 10 is Nylon 12 (with or without glass fiber), such as RTP 200F or RTP 201F available from RTP Company of Winona, Minnesota USA. Another example material for the device 10 is rigid thermoplastic polyurethane (with or without glass fiber), such as RTP 2300 or RTP 2301 available from RTP Company of Winona, Minnesota USA. Still another example material for the device is Acetal (Polyoxymethylene (POM)) (with or without glass fiber), such as RTP 800 or RTP 801 available from RTP Company of Winona, Minnesota USA.

Additionally, the relative dimensions and shape of the device 10 at the joints 25A, 25B and at the medial and lateral side arms 16, 18 contributes to the spring-biased nature of the device 10, and its ability to elastically deform under a desired amount of loading and return to its original, unloaded position. The device 10 may be configured to elastically bend under a maximum force of 160N. For example, the medial side arm 16 and the lateral side arm 18 may each have a thickness greater than a width at the respective joint 25A, 25B. The thickness is measured in the fore-aft (longitudinal) direction of the footwear. The width is measured in the medial-lateral (transverse) direction of the footwear. The greater thickness increases the required force to resiliently bend the device 10 to the loaded position.

Figure 4:
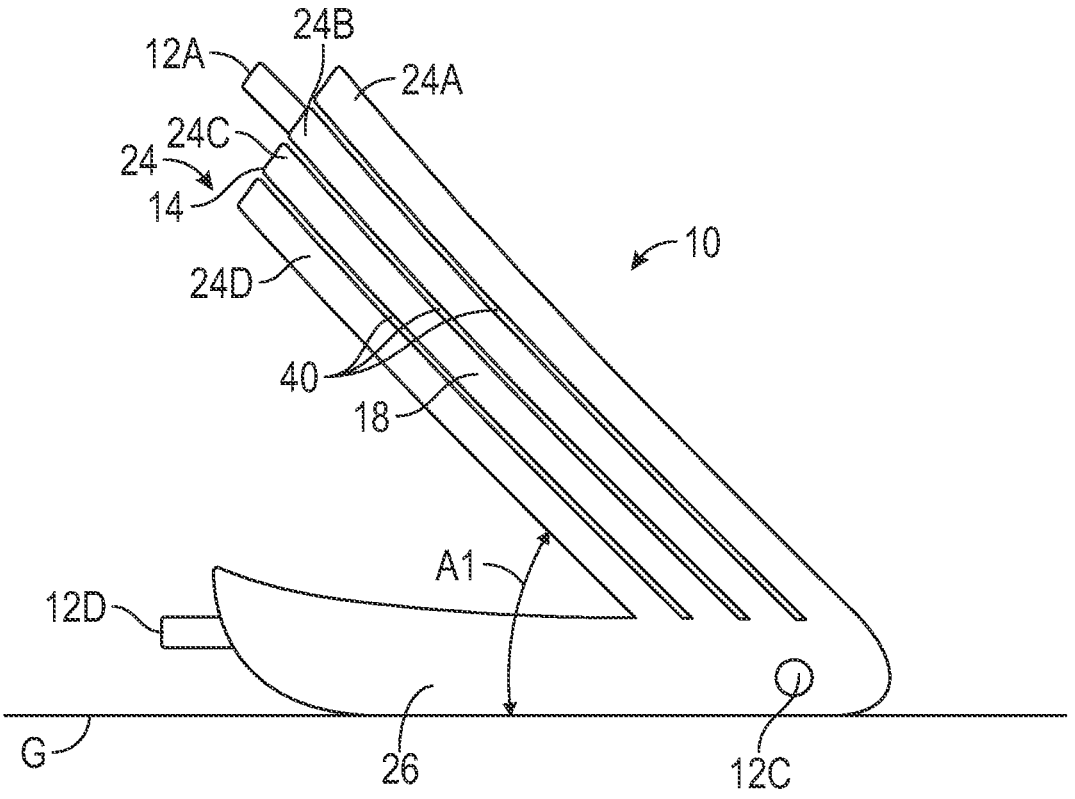
FIG. 4 is a lateral side view of the heel support device.

With reference to FIG. 4, the control bar 24 is biased to the unloaded position. Stated differently, the material of the device 10 is biased to the unloaded position of FIG. 4 by the material in its formed state. The material of the device 10 will resist loading, with internal stresses that bias the device 10 to return to the unloaded position when the load is removed. The material of the control bar 24 is sufficiently rigid that it remains in the unloaded position in its natural state without external loads applied to it, and will return to the unloaded position after elastic bending due to its resiliency. In the unloaded position, the center segment 14 of the control bar 24 is further from the base 26 than in the loaded position of FIG. 5.

When the control bar 24 is in the unloaded position, the control bar 24 extends at a first acute angle A1 to a horizontal plane of the ground G on which the base 26 rests. The angle A1 may be measured at the lower edge of the control bar 24 or along a longitudinal axis of either side arm, or each of the medial side arm 16 and the lateral side arm 18 could have a first acute angle with a different numerical value. Adjacent slats 24A, 24B, 24C, 24D are spaced apart from one another by the slots 40 in the unloaded position.

Figure 5:
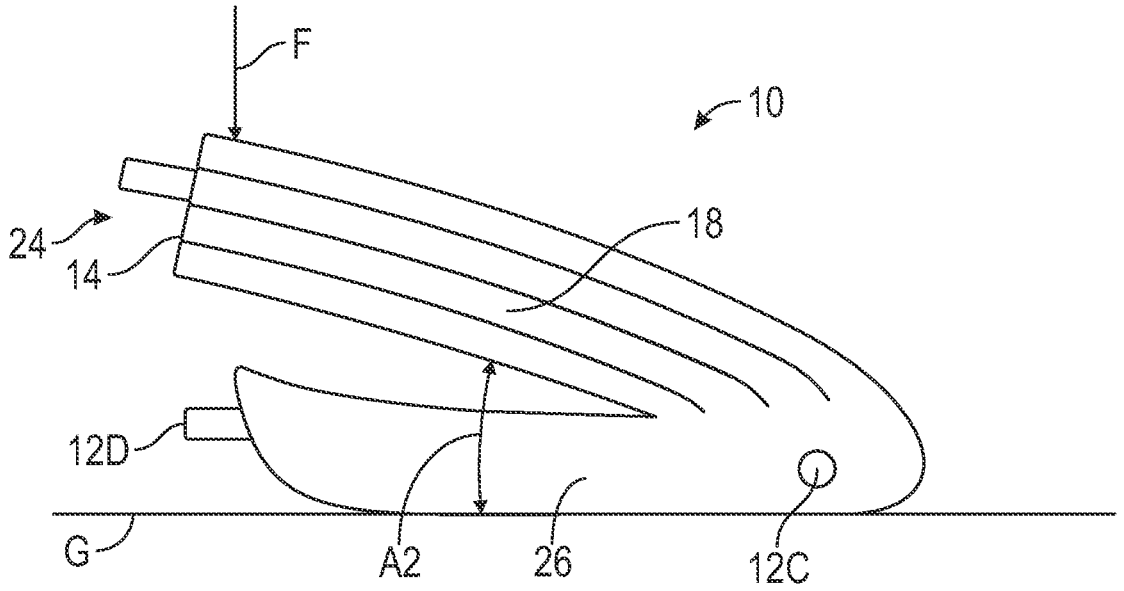
FIG. 5 is a lateral side view of the heel support device under loading.

FIG. 5 shows the device 10 during loading by an applied force F (e.g., a load of a foot during foot entry into a foot-receiving cavity of an article of footwear) pressing downward on the center segment 14 of the control bar 24. The medial side arm 16 and the lateral side arm 18 extend at a second acute angle A2 to the plane of the ground G, on which the base 26 rests, when the control bar 24 is depressed so that the device 10 is in the position of FIG. 5. The angle A2 may be measured at the lower edge of the control bar 24 or along a longitudinal axis of either side arm. As shown in FIG. 5, the slots 40 close between the slats 24A, 24B, 24C, and 24D so that one or more adjacent slats 24A, 24B, 24C, 24D contact one another in the loaded position. The second acute angle A2 is less than the first acute angle A1. The device 10 elastically bends (e.g., elastically deforms) under the applied force F to the loaded position of FIG. 5 in which the center segment 14 of the control bar 24 is closer to the base 26 than in the unloaded position, storing potential energy that returns the control bar 24 to the unloaded position upon removal of the applied force F. For example, a foot can press down on the control bar 24, and slip into the foot-receiving cavity of an attached footwear upper without requiring the use of a hand or of any tool to adjust the upper for foot entry.

Figure 6:
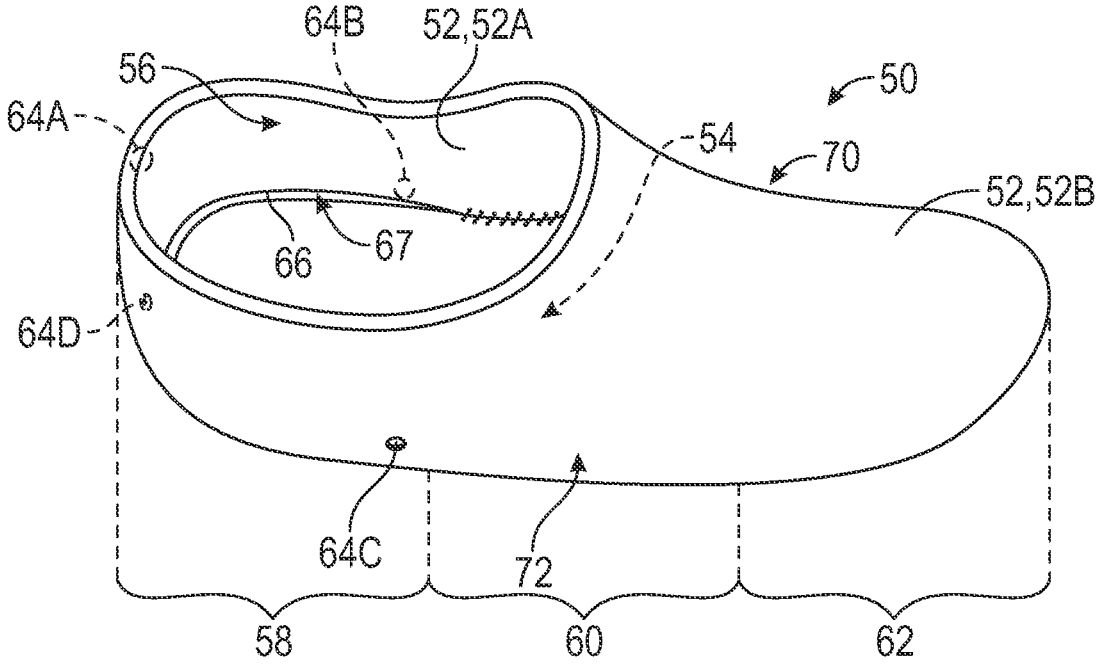
FIG. 6 is a lateral perspective view of an article of footwear showing an upper before insertion of the heel support device of FIG. 1.

FIG. 6 shows an article of footwear 50 with an upper 52 and a sole structure 53 before the device 10 is inserted into and secured to the upper 52. The footwear 50 herein is depicted as a leisure shoe or an athletic shoe, but the present teachings also include an article of footwear that is a dress shoe, a work shoe, a sandal, a slipper, a boot, or any other category of footwear.

The upper 52 includes an inner layer 52A and an outer layer 52B. The upper 52 defines a foot-receiving cavity 54 inward of the inner layer 52A, and an ankle opening 56 for access to the cavity 54. The inner layer 52A is disposed between the foot-receiving cavity 54 and the outer layer 52B (e.g., closer to a foot disposed within the foot-receiving cavity 54). The upper 52 may be a variety of materials or combination of materials, such as a 4-way stretch nylon fabric, a knit construction, or other material. The material of the upper 52 may be flexible to allow movement of the upper 52 with the device 10 during easy access foot entry into the article of footwear 50 as described herein. The outer layer 52B may be referred to as a first layer of the upper 52, and is comprised of a first material having a first melt temperature and a first burn temperature.

The article of footwear 50 includes a heel region 58, a midfoot region 60, and a forefoot region 62. The heel region 58 generally includes portions of the article of footwear 50 corresponding with rear portions of a human foot, including the calcaneus bone, when the human foot is supported on the sole structure 53 in the foot-receiving cavity 54 and is a size corresponding with the article of footwear 50. A forefoot region 62 of the article of footwear 50 generally includes portions of the article of footwear 50 corresponding with the toes and the joints connecting the metatarsals with the phalanges of the human foot (interchangeably referred to herein as the "metatarsophalangeal joints", "metatarsal-phalangeal joints", or "MPJ" joints). A midfoot region 60 of the article of footwear is disposed between the heel region 58 and the forefoot region 62 and generally includes portions of the article of footwear 50 corresponding with an arch area of the human foot, including the navicular joint.

The sole structure 53 includes one or more sole components that may be sole layers, such as an outsole, a midsole, or a unitary combination of an outsole and a midsole that may be referred to as a unisole. A lower portion of the footwear upper 52 may be secured to the sole structure 53, such as by adhesive or otherwise and/or may be stitched or otherwise secured to a strobel that is in turn secured to the sole layer.

The outer layer 52B of the upper 52 has apertures 64A, 64B, 64C, and 64D arranged in the same first arrangement relative to one another as the pegs 12 of the device 10 and can therefore serve as complementary locating features for the pegs 12. Aperture 64A is at a rear of the heel region 58, relatively high on the upper 52. Aperture 64B is at a medial side 70 of the article of footwear 50. Aperture 64C is at a lateral side 72 of the article of footwear 50. Aperture 64D is at the rear of the heel region 58, relatively low on the upper 52 such that it is closer to the sole structure 53 than aperture 64A, and generally vertically aligned with (e.g., falling directly below) aperture 64A. Apertures 64A and 64D are spaced apart from one another with the same spacing (e.g., distance between the apertures 64A, 64D) as pegs 12A and 12D. The apertures 64B and 64C are spaced apart from one another with the same spacing (e.g., distance between the apertures 64B, 64C) as pegs 12B, 12C. Apertures 64B and 64C are also spaced apart from apertures 64A and 64D with the same spacing as pegs 12B and 12C are spaced relative to pegs 12A and 12D. The apertures 64A, 64B, 64C, and 64D extend through the outer layer 52B as through holes. The inner layer 52A need not have apertures for connection of the device 10 within the article of footwear 50.

As shown in FIG. 6, a lower edge 66 of the inner layer 52A is left unsecured in the heel region 58 at this stage in the manufacturing to create an opening 67 to allow insertion of the device 10 between the inner layer 52A and the outer layer 52B. Forward of the heel region 58, the inner layer 52A may be sewn or otherwise secured to the sole structure 53, to a strobel, or to the outer layer 52B. The opening 67 extends from the medial side 70 around the rear of the heel region 58 to the lateral side 72.

Figure 7:
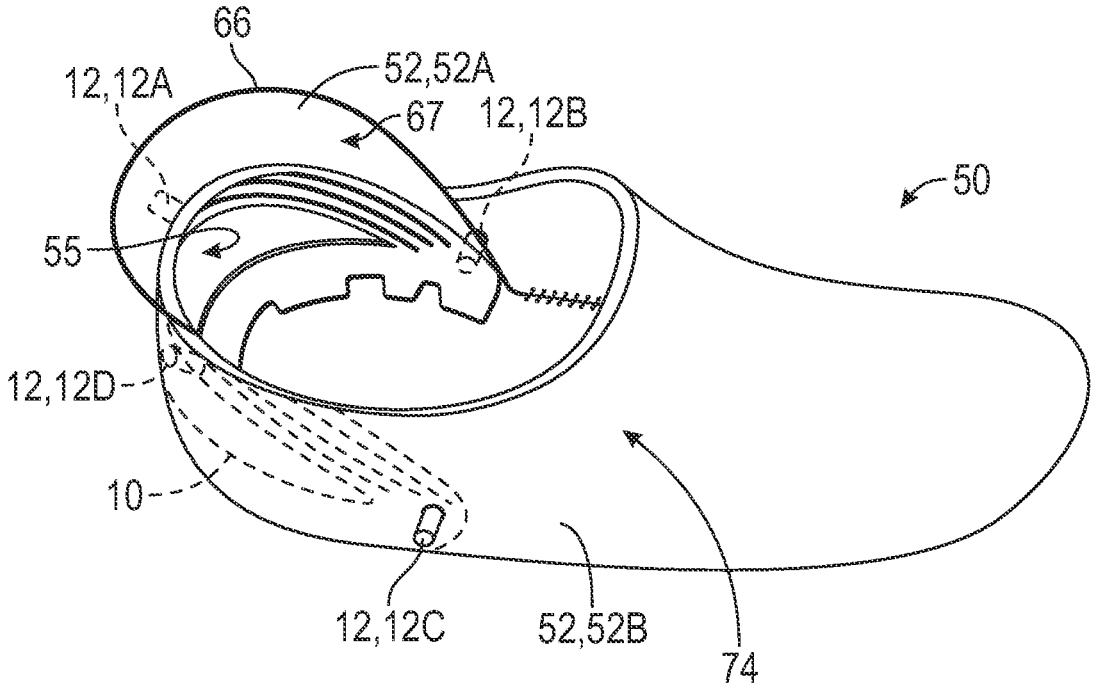
FIG. 7 is a lateral perspective view of the article of footwear showing the heel support device inserted through an opening between an inner layer and an outer layer of the upper with pegs extending through apertures in the outer layer.

As shown in FIG. 7, the inner layer 52A is a pliable material, such that it can be lifted at the lower edge 66 where it is unsecured to enlarge the opening 67, allowing the device 10 to fit through the opening 67 to be placed against the inside of the outer layer 52B. Stated differently, the device 10 is placed at a first side of the outer layer 52B, which is the side proximate the foot-receiving cavity 54 (e.g., the inner side). The device 10 is placed proximate to the inner surface 55 of the outer layer 52B, the inner surface 55 facing the foot-receiving cavity 54. Adhesive may be used to secure the lower surface of the base 26 to the sole structure 53 and/or to a strobel. Because the apertures 64A, 64B, 64C, and 64D are arranged in the same spacing as the pegs 12A, 12B, 12C, 12D, respectively, the device 10 can be inserted in the opening 67 with the pegs 12A, 12B, 12C, 12D extending outward toward the outer layer 52B, and the device 10 may be placed against the inside of the outer layer 52B with the apertures 64A, 64B, 64C, and 64D aligned with the pegs 12A, 12B, 12C, and 12D. The pegs 12A, 12B, 12C, and 12D can be inserted through the apertures 64A, 64B, 64C, and 64D, respectively, by slipping the flexible outer layer 52B over the pegs 12A, 12B, 12C, and 12D so that the pegs 12A, 12B, 12C, and 12D extend through the outer layer 52B and are exposed at an exterior surface 74 of the outer layer 52B (also referred to as the outer surface 74 of the outer layer 52B). The outer surface 74 faces away from the foot-receiving cavity 54.

Figure 8:
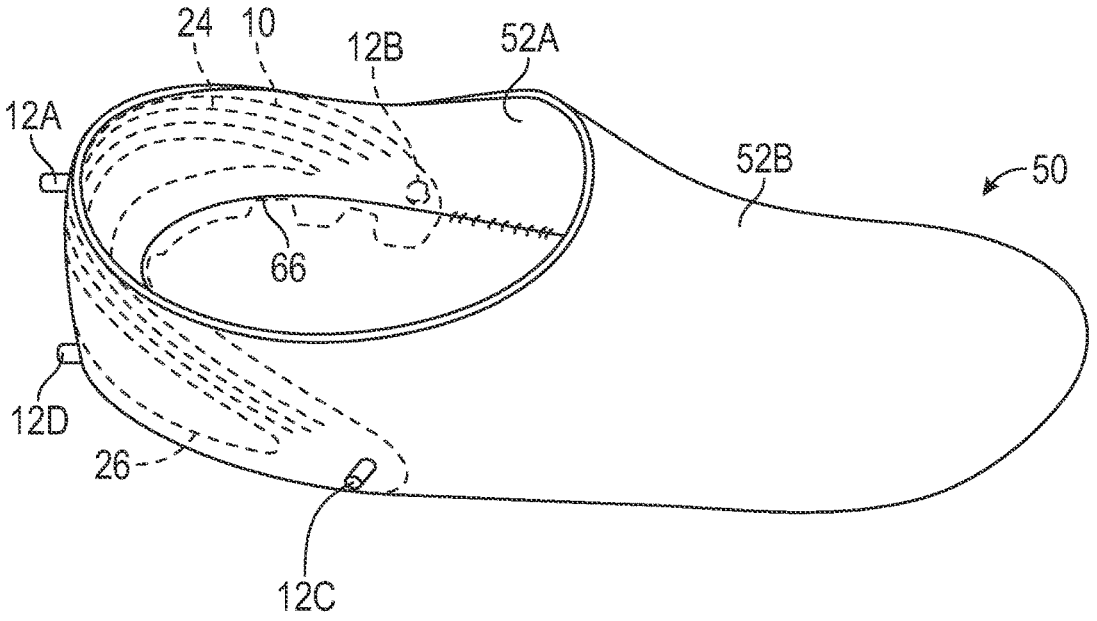
FIG. 8 is a lateral perspective view of an article of footwear with the opening between the inner layer and the outer layer closed.
Figure 9:
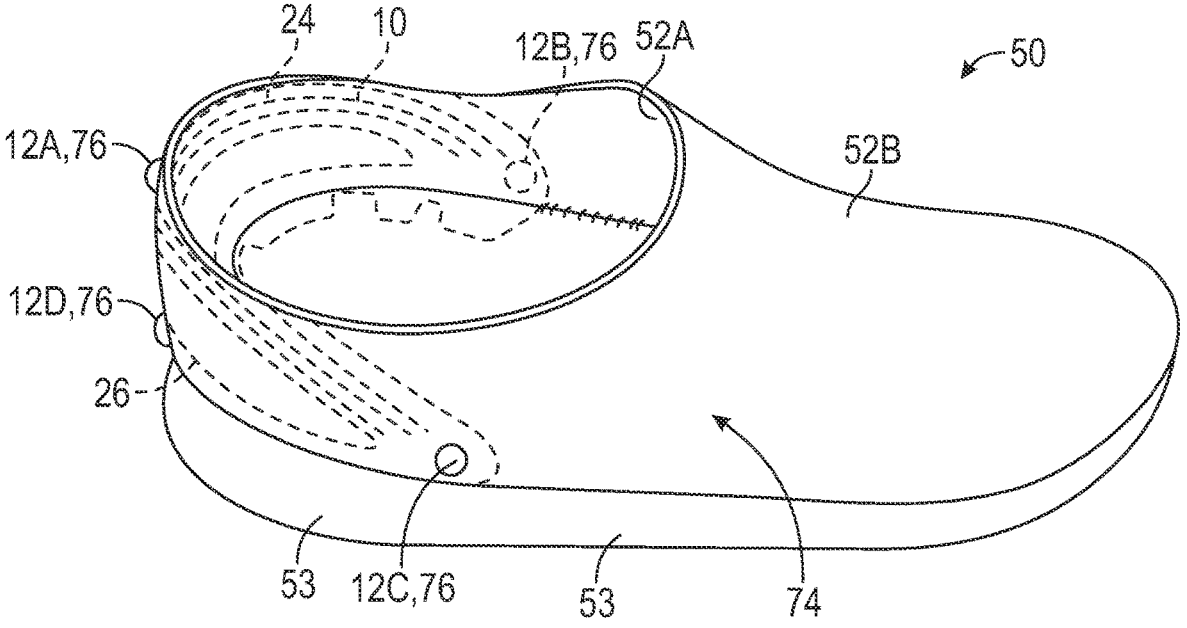
FIG. 9 is a lateral perspective view of an article of footwear showing head portions of the pegs secured to the outer layer of the upper.

As shown in FIG. 8, the opening 67 can then be closed by securing the lower edge 66 of the inner layer 52A to the outer layer 52B or to a strobel or to the upper side of the base 26 near the notches. With the inner layer 52A secured, the device 10 is disposed between the inner layer 52A and the outer layer 52B. The inner layer 52A is disposed inward of the heel support device 10, between the heel support device 10 and the foot-receiving cavity 54. The device 10 is configured to surround a portion of a foot-receiving cavity 54 at the heel region 58.

In FIG. 8, the pegs 12A, 12B, 12C, and 12D extend outward of the outer layer 52B. However, the pegs 12A, 12B, 12C, and 12D are roughly the same size diameter or smaller in diameter than the apertures 64A, 64B, 64C, and 64D. In order to further secure the device 10 in position relative to the upper 52, the pegs 12A, 12B, 12C, and 12D are secured at the exterior surface 74 of the outer layer 52B at the apertures 64A, 64B, 64C, and 64D. More specifically, the material at the ends of each of the pegs 12A, 12B, 12C, and 12D is melted and shaped to form a head portion of the peg that is larger than the aperture and larger than the remaining shaft portion that extends through the aperture. The melted material forms enlarged head portions 76 of the pegs 12A-12D shown in FIG. 9. The enlarged head portions 76 may also be referred to as broadened heads. In some implementations, the melted material of the enlarged head portions 76 may bond to the exterior surface 74 around the apertures 64A, 64B, 64C, 64D when it cools. The formation of the enlarged head portions 76 of the pegs is described further with respect to FIGS. 12-16. Bonding the head portions 76 to the outer layer 52B may occur while the upper 52 and device 10 are on a last. Next, a sole structure 53 can then be secured to a lower periphery of the upper 52, to a strobel, and/or to the bottom side of the device 10 near the notches 30. Alternatively, the device 10 may be inserted between the layers of the upper 52 as shown in FIGS. 6-9, and bonding the head portions 76 to the outer layer 52B may occur after the upper 52 has been lasted, secured to the sole structure 53 on the last, and removed from the last.

Figure 10:
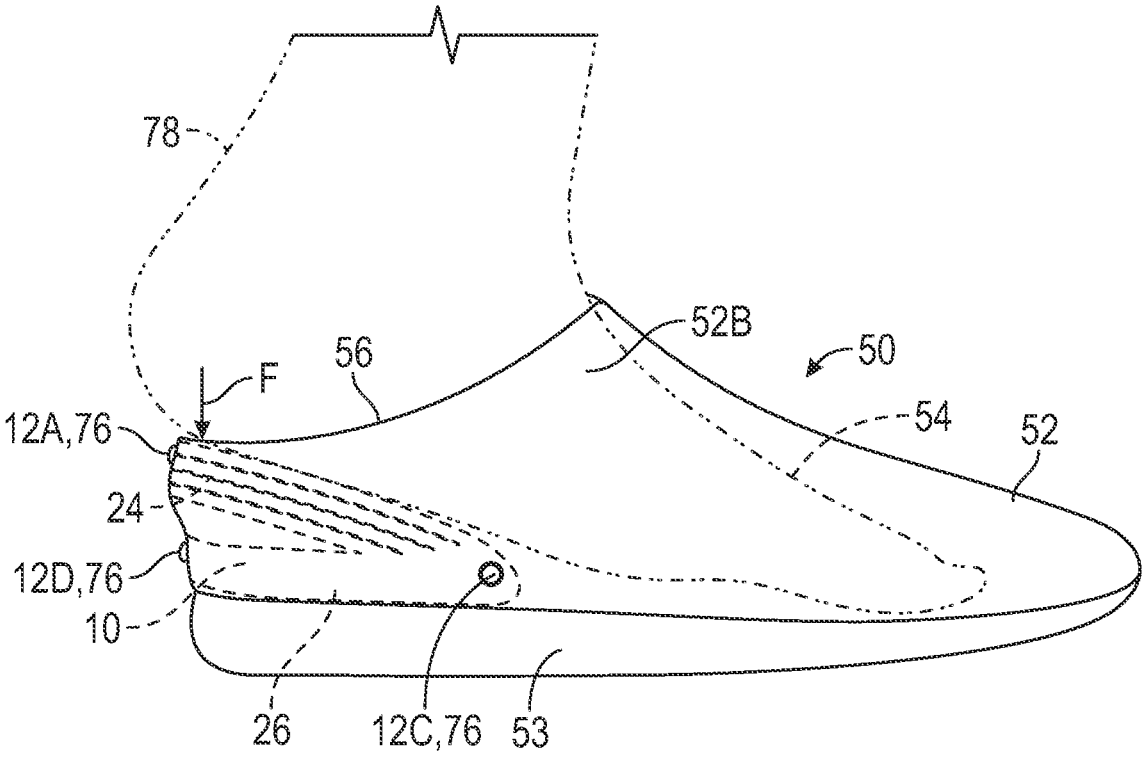
FIG. 10 is a lateral side view of the article of footwear with a foot shown in phantom depressing the heel support device during insertion.

FIG. 10 shows a foot 78 shown in phantom applying a force F on the control bar 24 of the device 10, moving the device 10 to the loaded position. Because the upper 52 is secured to the device 10 at the pegs 12 by the head portions 76, the upper 52 folds downward with the device 10 at the heel region 58, causing the ankle opening 56 to extend further rearward and downward when the control bar 24 is in the loaded position than when the control bar is in the unloaded position shown in FIG. 11. When the foot 78 is moved forward and downward into the foot-receiving cavity 54, the bias of the device 10 returns the device 10 to the unloaded position of FIG. 11.

Figure 11:
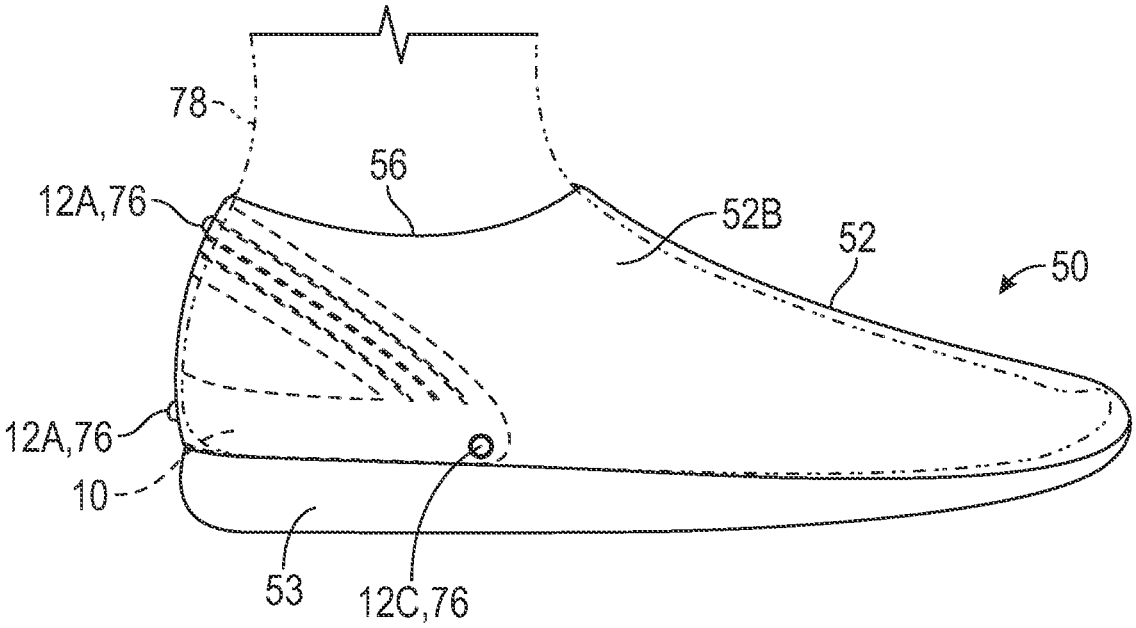
FIG. 11 is a lateral side view of the article of footwear with the foot fully inserted.

Traditionally, slipping a foot into an upper often requires the use of one or both hands to stretch the ankle opening and hold the rear portion during foot insertion, especially in the case of a relatively soft upper and/or an upper that does not have a heel counter secured to the flexible fabric rearward of the ankle opening. The device 10 alleviates these issues, and allows the foot 78 to enter into the foot-receiving cavity 54 formed by the upper 52 without the use of hands or other tools. Only the foot 78 is used to gain entry. Specifically, using the bottom of the foot 78, a force F is applied to press on the control bar 24 as shown in FIG. 10, resiliently bending the device 10 at the joints 25A, 25B moving the control bar 24 from the unloaded position to the loaded position. The outer layer 52B of the upper 52 is attached to the center segment 14 of control bar 24 at the peg 12A, and is sufficiently pliable to move down with the control bar 24. The stored elastic energy due to the bias of the device 10 automatically returns the device 10 to the unloaded position when the foot 78 moves fully into the foot-receiving cavity 54, causing the upper 52 to be automatically pulled up over the back of the foot 78 as shown in FIG. 11. The device 10 may also be configured to widen as it is moved from the unloaded position to the loaded position. This helps ease insertion of the foot 78 into a flexible upper 52, as the medial side arm 16 and the lateral side arm 18 may bow apart from one another in the transverse direction when the control bar 24 is depressed, pulling the upper 52 attached at the pegs 12 outward.

The article of footwear 50 is characterized by the absence of a rigid material, such as a rigid heel counter between the control bar 24 and the base 26 aft of the junction 25A, 25B between the control bar 24 and the base 26. The device 10 functions at least in some respects as a heel counter in that it helps to retain a wearer's heel in position atop a heel region 58 of the sole structure 53, preventing medial or lateral displacement during use.

Figure 12:
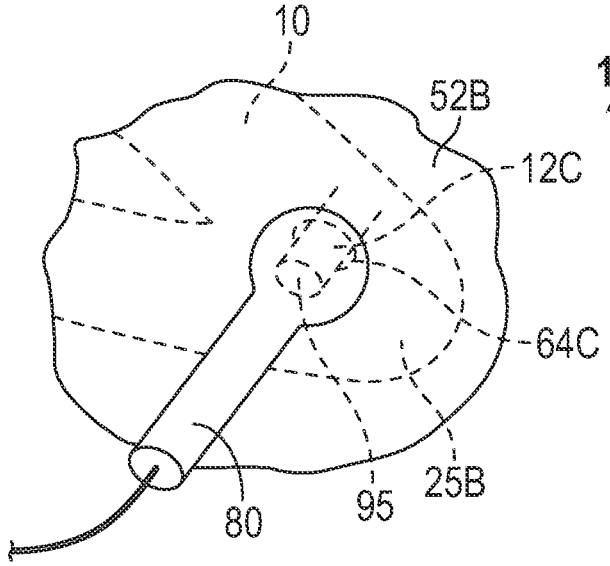
FIG. 12 is a fragmentary perspective view of the article of footwear and a tool heating an end of one of the pegs of the heel support device.
Figure 13:
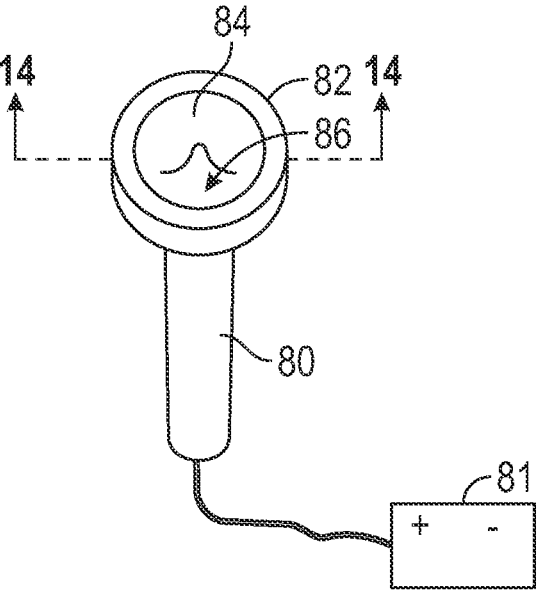
FIG. 13 is a perspective view of the tool.
Figure 15:
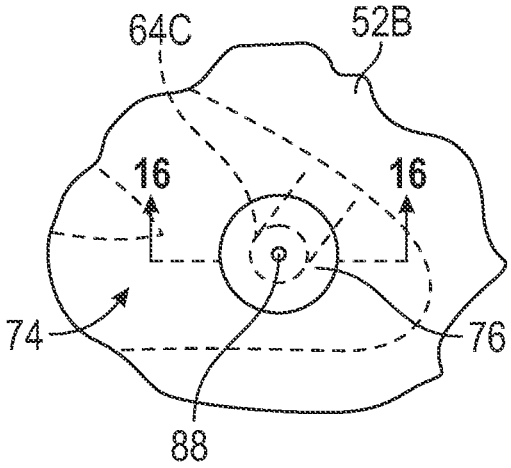
FIG. 15 is a fragmentary perspective view of the article of footwear with a head portion of the peg secured to an exterior surface of the upper via the tool of FIG. 12.

FIG. 12 shows a tool 80 being used to melt the material at the end of the peg 12C to form the head portion 76, shown in FIG. 15. The tool 80 may be, for example, an ultrasonic welding tool that converts electrical power into ultrasonic vibrations that create sufficient friction to generate heat, causing the material of the peg 12C to melt. FIG. 13 shows the tool 80 powered by a power source 81 such as a battery or an electrical outlet. One example tool 80 is an ultrasonic welding tool available as the Dukane iQ Ultrasonic Welder available from Dukane Corporation of Saint Charles, Illinois USA.

Figure 14:
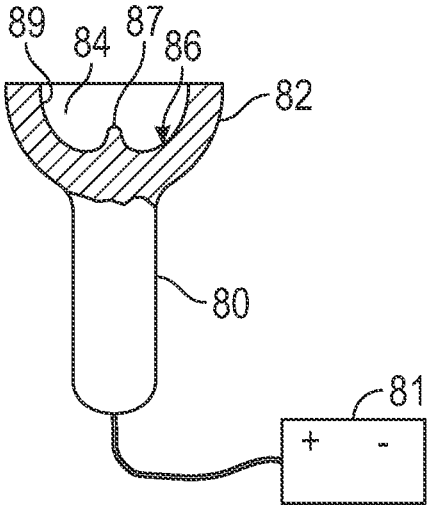
FIG. 14 is a partial cross-sectional view of the tool taken at lines 14-14 in FIG. 13.
Figure 16:
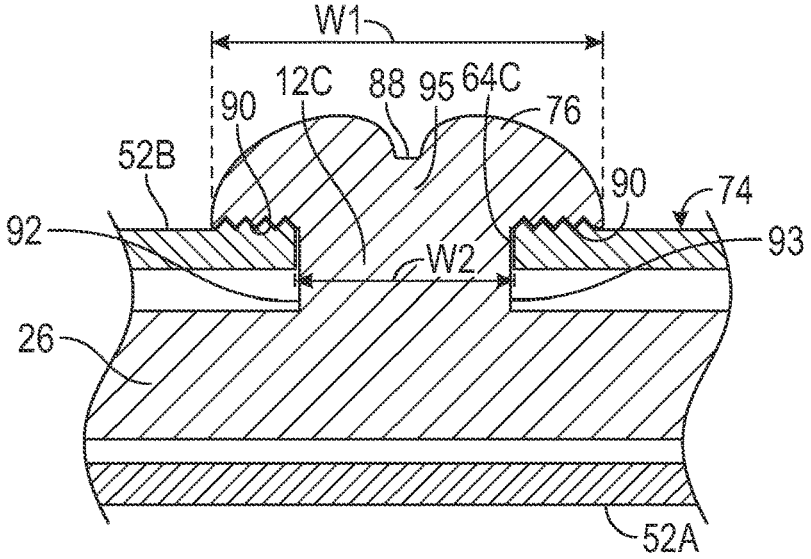
FIG. 16 is a fragmentary cross-sectional view of the peg and upper of FIG. 15 taken at lines 16-16 in FIG. 15.

The tool 80 has an end 82 forming a mold cavity with a mold surface 86. As shown in FIG. 14, the mold cavity 84 is generally hemispherical, with a central protrusion 87 in the mold surface 86. FIG. 16 shows that the mold cavity 84 and mold surface 86 shape the melted material into a head portion 76 with a central recess 88. The end 82 has a circular opening 89 to the cavity 84. The circular opening 89 has a larger diameter than the peg 12C prior to melting of the end of the peg 12C. Accordingly, when the tool 80 is pressed against the exterior surface 74, the material of the peg 12C melts and then cools as the tool 80 is powered off. As the tool 80 remains in place against the outer layer 52B for a predetermined cooling time, the melted material will melt against and may thereby bond to the exterior surface 74 of the outer layer 52B around the aperture 64C, as illustrated at bonded areas 90 in FIG. 16. The melted material is referred to as the head portion 76 or broadened head. The head 76 extends from the remainder of the original, unmelted portion of the peg 12C, which is referred to as the shaft portion 92 or as a stem 92. The shaft portion 92 and the head portion 76 are of unitary, integral construction. The shaft portion 92 extends from a first end 93 joined with the base 26 (e.g., the body of the device 10) to a distal end 95 (also shown in FIG. 12) spaced apart from the first end 93 and which protrudes through the outer layer 52B at the aperture 64C to a second side of the outer layer 52B (e.g., the outer side at the exterior surface 74. The outer layer 52B is sufficiently pliable to allow the shaft portion 92 to be inserted through the aperture 64C to extend through the outer layer 52B so that the distal end 95 protrudes from the outer layer 52B. For example, the outer layer 52B is sufficiently pliable so that the shaft portion 92 may be manually (or by robotic machine) caused to extend through the first layer 52B. The shaft portion 92 extends through the first layer 52B from the first side of the first layer 52B (e.g., the inner side at the inner surface 55) and protrudes from the first layer 52B at the second side of the outer layer 52B (e.g., at the outer side at the exterior surface 74). Additionally, in some implementations, the outer layer 52B may not have pre-formed apertures in the first spacing, but may be sufficiently pliable to allow the shaft portion 92 to either stretch or pierce the material of the outer layer 52B. After the shaft portion 92 is caused to extend through the first layer 52B and protrude at the outer side, the tool 80 may be hand held, and pressed against the exterior surface 74 at each peg 12 one at a time to melt the material of the shaft portion 92 at the distal end 95, forming a head portion 76 at each peg 12. The head portion 76 provided at the distal end 95 has a width W1 greater than a width W2 of the corresponding aperture 64C through which the shaft portion 92 extends.

The outer layer 52B is a first material having a first melt temperature, and the peg 12, or at least the material at the distal end 95 of the peg 12 that is melted to form the head portion 76, is a second material having a second melt temperature lower than the first melt temperature. The burn temperature of the first material of the outer layer 52B is also higher than the melt temperature of the second material of the peg 12. Accordingly, melting the material of the peg 12 at the distal end 95 to form the head portion 76 with the tool 80 will not cause the outer layer 52B to either melt or burn, even if the head portion 76 bonds to the outer layer 52B.

Figure 17:
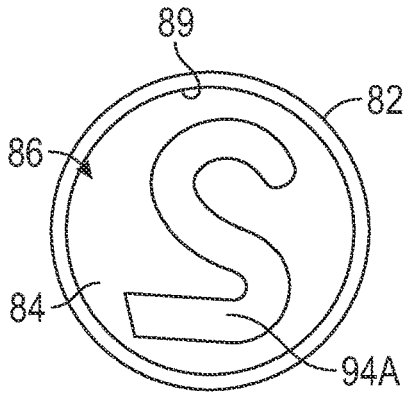
FIG. 17 is a plan view of a mold surface of the tool of FIG. 12.
Figure 18:
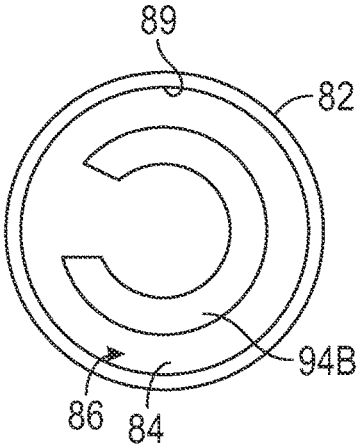
FIG. 18 is a plan view of another mold surface for the tool of FIG. 12.
Figure 19:
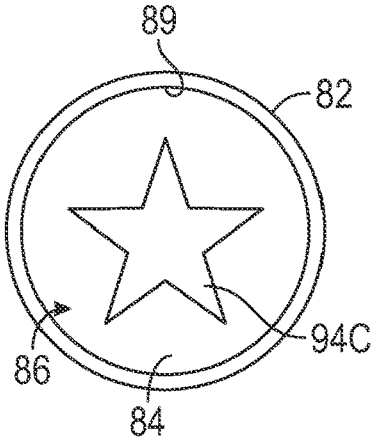
FIG. 19 is a plan view of another mold surface for the tool of FIG. 12.
Figure 20:
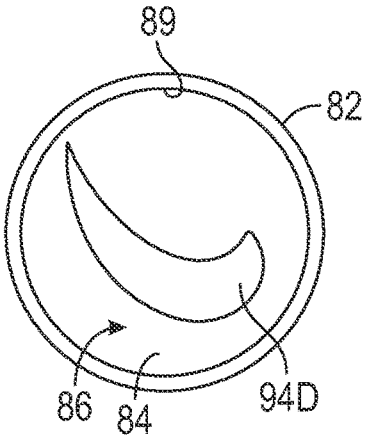
FIG. 20 is a plan view of another mold surface for the tool of FIG. 12.
Figure 21:
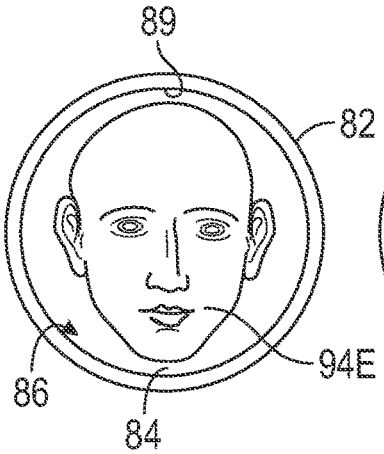
FIG. 21 is a plan view of another mold surface for the tool of FIG. 12.
Figure 22:
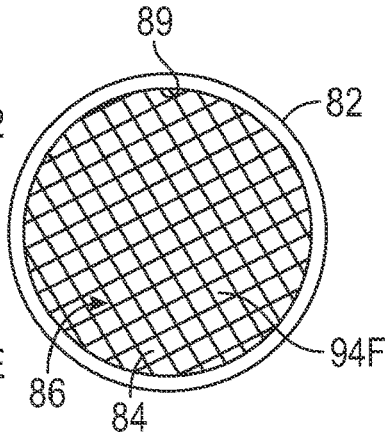
FIG. 22 is a plan view of another mold surface for the tool of FIG. 12.

The head portion 76 may have various shapes or textures in order to achieve structural integrity of the bond to the outer layer 52B, to achieve a particular aesthetic, or both. For example, the mold cavity 84 and mold surface 86 affect the final shape of the head portion 76. Providing a circular opening enables bonding of the melted material around the entire perimeter of the aperture 64C. The opening 89 could have other shapes, such as a square, a triangle, a star, etc. The mold cavity and mold surface provide a generally hemispherical shape of the head portion 76. In other embodiments, the outer surface of the head portion 76 furthest from the exterior surface 74 could be generally flat, such as head portion shaped as a flat nail head. Additionally, the mold surface 86 can have protrusions or recessions that create a shape on the surface of the head portion 76. FIG. 17 shows a recess or protrusion 94A in the shape of a reversed number 2 that will result in a number 2 on the surface of the head portion 76. FIG. 18 shows a recess or protrusion 94B in the shape of a reversed letter C that will result in a letter C on the surface of the head portion 76. FIG. 19 shows a recess or protrusion 94C in the shape of an object that is a star that will result in a star on the surface of the head portion 76. FIG. 20 shows a recess or protrusion 94D in the shape of a symbol or logo that will result in the shape of the symbol or logo on the surface of the head portion 76. FIG. 21 shows recesses and protrusions 94E in a design that is a face and that will result in the image of the face on the surface of the head portion 76. FIG. 22 shows recesses or protrusions 94F depicting a cross-hatch pattern and texture, and that will result in a cross-hatch pattern and texture on the surface of the head portion 76.

According to the method of manufacturing the article of footwear 50, the heating tool 80 may be selected from a group of tools each having a mold surface 86 with a different shape depicting at least one of a number, a letter, a symbol, a logo, an object, a design, and/or each having a different surface texture, examples of which are shown in FIGS. 15 and 17-22. Selecting the specific heating tool may be in response to a request for a head portion 76 with a specific shape or surface texture. The mold surface 86 of the heating tool 80 selected may have the specific shape or surface texture. The resulting head portion 76 of the peg 12 made with the selected heating tool 80 will then have the requested specific shape, which may depict at least one of a number, a letter, a symbol, a logo, an object, or a design, or the requested specific surface texture. The request may also be for the head portions 76 to be a specific color, and the device 10 may be manufactured with a material having the requested specific color. Additionally, the pegs 12 need not be the same, and the request may include that one or more of the pegs 12 depict a different number, letter, symbol, logo, object, design, or different surface texture or color than one or more of the other pegs 12.

Figure 23:
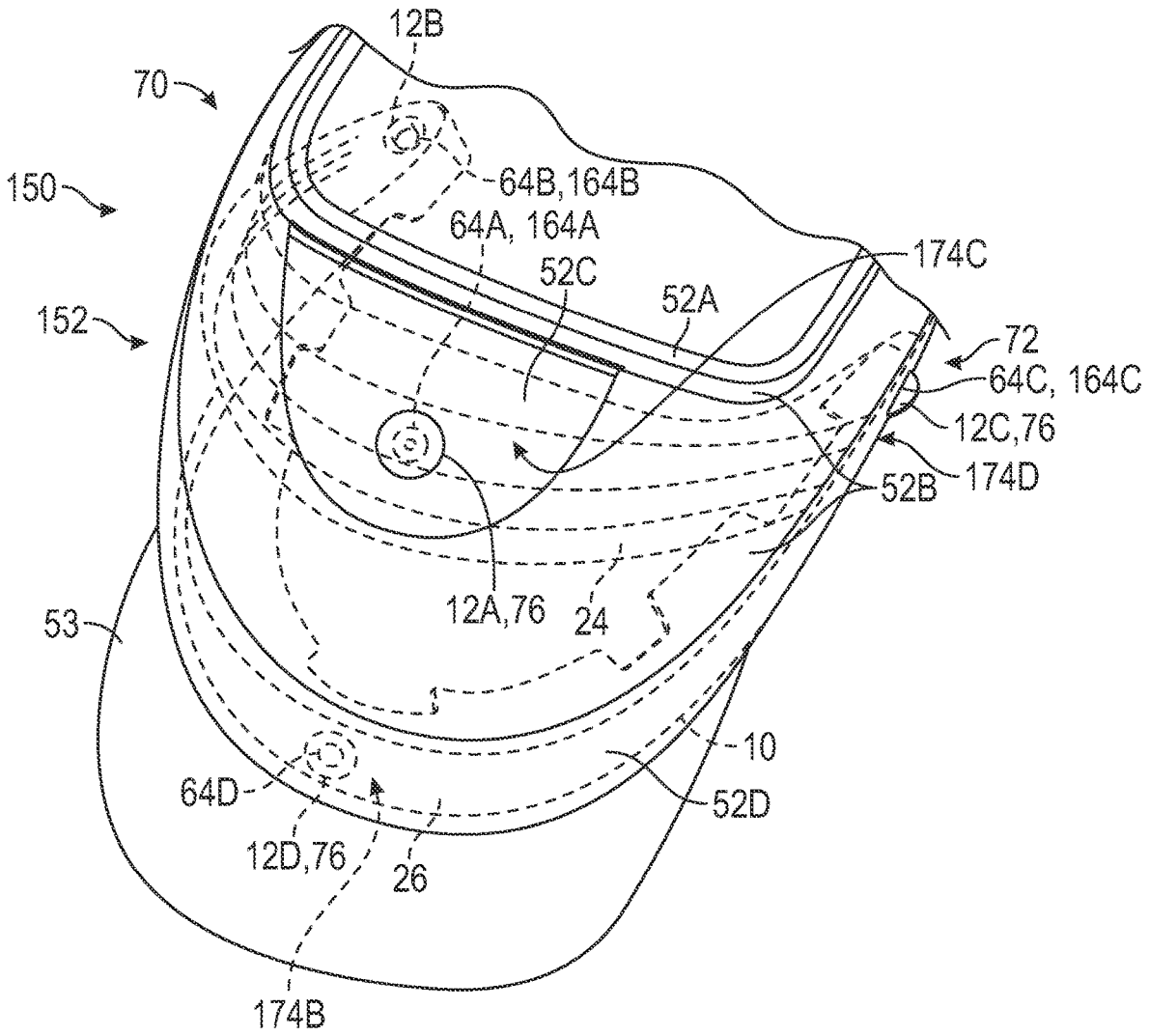
FIG. 23 is rear perspective and fragmentary view of another article of footwear with the heel support device.

In some embodiments, the upper may have multiple outer layers (e.g., layers outward of the device 10), and the pegs 12 may extend through some or all of these outer layers. For example, FIG. 23 shows a rear portion of another article of footwear 150. The article of footwear 150 has an upper 152 that includes multiple outer layers. The upper 152 includes the inner layer 52A and the outer layer 52B. Additionally, the upper 152 includes an outer layer 52C secured to the outer layer 52B. The outer layer 52C also has an aperture 164A that is aligned with the aperture 64A of the outer layer 52B. The peg 12A extends through both apertures, and the head portion 76 of the peg 12A is melted to form a head portion 76 disposed at the exterior surface 174C, and which may secure against (e.g., bond to) the exterior surface 174C of the outer layer 52C. Similarly, at the lateral side 72, the peg 12C extends through an aperture 164C in outer layer 52D as well as through the aperture 64C (see FIG. 6) in outer layer 52B so that the head portion 76 is disposed at the exterior surface 174D and may be secured to the exterior surface 174D of the outer layer 52D. The head portion 76 of peg 12B is similarly disposed at the medial side 70 at an aperture 164B in outer layer 52D that is aligned with the aperture 64B. In contrast, the head portion 76 of peg 12D is disposed at and possibly bonded to the exterior surface 174B of the outer layer 52B, just as in FIG. 9, and the outer layer 52D extends over and covers the head portion 76 of peg 12D. The outer layer 52D protects the head portion 76 of the peg 12D. The head portion 76 of the peg 12D may instead be disposed lower on the article of footwear 150 such that it is covered by the rear of the sole structure 53. In either case, the head portion 76 may have the hemispherical shape resulting from mold cavity 84, or may have another shape. For example, the head portion 76 may have a generally flat outer surface, such as that of a flat nail head, in order to minimize distortion of the outer layer 52D or the sole structure 53.

Figure 24:
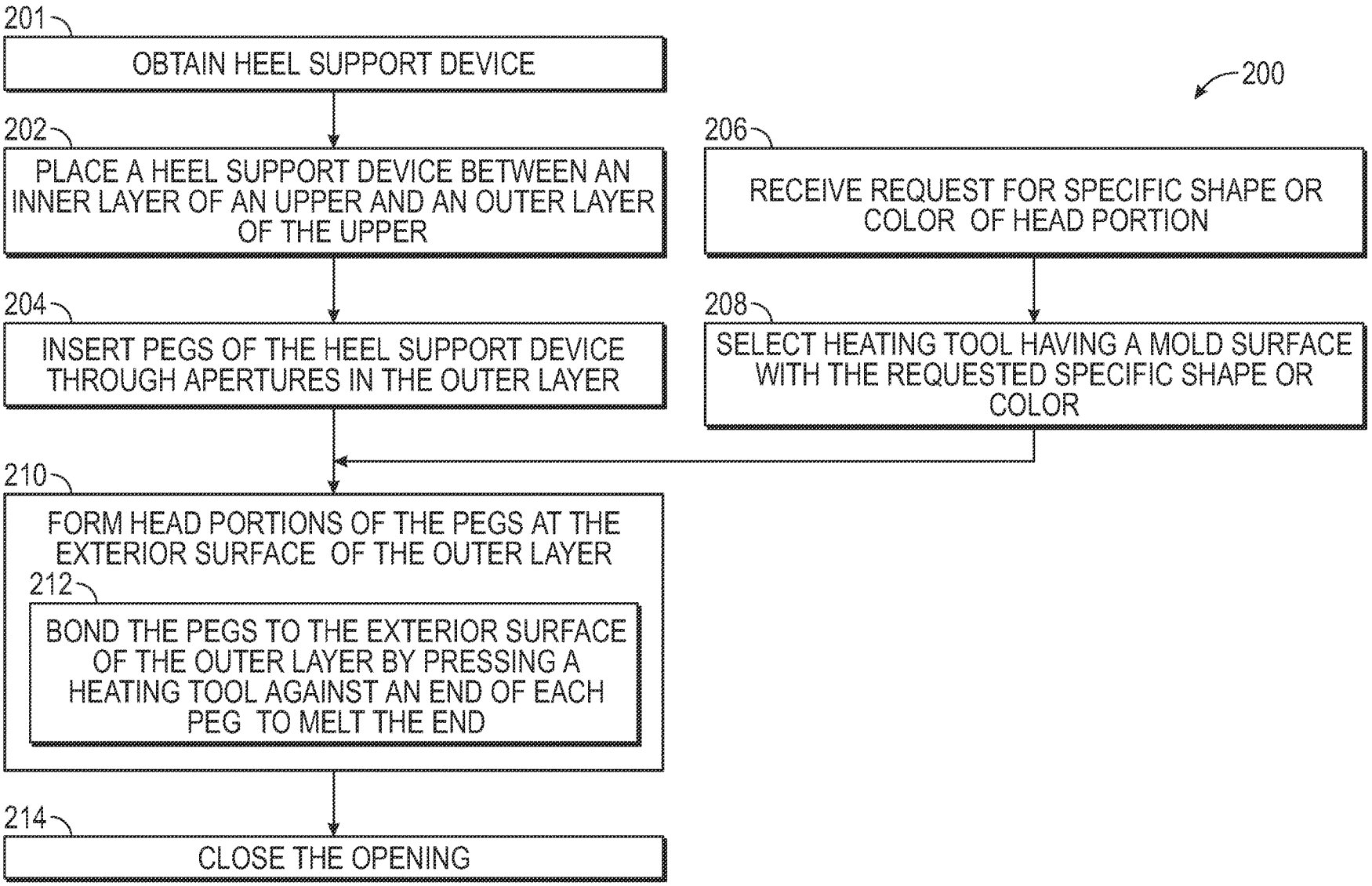
FIG. 24 is a flow chart of a method of manufacturing an article of footwear.

FIG. 24 is a flow chart of a method of manufacturing an article of footwear described herein, such as the article of footwear 50 or the article of footwear 150, and is referred to as the method of manufacturing 200. The method of manufacturing 200 is described with respect to the article of footwear 50. The method begins with step 201, obtaining a footwear element, such as the heel support device 10, that has a peg 12 and a stem (e.g., shaft portion 92). The method of manufacturing 200 may then proceed to step 202, placing a heel support device between an inner layer and an outer layer of an upper. For example, step 202 may be carried out by placing heel support device 10 between the inner layer 52A and the outer layer 52B of upper 52. Once the device is placed between the layers 52A, 52B, the method moves to step 204, causing the stem 92 to extend through the first layer (outer layer 52B) of the upper 52 and protrude from the first layer (e.g., at the exterior surface 74), such as by inserting pegs that extend outward from the heel support device between the inner layer and the outer layer. For example, the pegs 12 of the heel support device 10 may be inserted through apertures 64A, 64B, 64C, and 64D in the outer layer 52B. The apertures 64A, 64B, 64C, and 64D and the pegs 12 may both be arranged in a first arrangement (e.g., they both have the same relative spacing).

Additionally, the method of manufacturing 200 may enable the head portions 76 of the pegs 12 to be customized. For example, in step 206, the manufacturer may receive a request for a heel support device with one or more head portions having a specific shape, a specific surface texture, and/or a specific color. The request may be for a specific shape of one or more of the head portions 76 of the heel support device 10, such as a shape depicting at least one of a number, a letter, a symbol, a logo, an object, a design, or for a head portion 76 with a specific surface texture, or for a head portion 76 with a specific color, as discussed herein. The request may be received directly from a consumer purchasing the article of footwear 50, or may be received from an entity who will sell the footwear 50 to the customer. Under step 208, in response to the request received in step 206, the manufacturer may then select a specific heating tool that has a mold surface with the requested specific shape or surface texture such as by selecting a specific heating tool 80 for the heel support device 10, and if a specific color is requested, may use a material of the specific color for the heel support device.

Either following step 208 or, in the absence of steps 206 and 208, then directly following step 204, the method of manufacturing 200 moves to step 210, in which the head portions 76 of the pegs 12 are formed at the exterior surface of the outer layer. For example, step 210 may be accomplished according to sub-step 212, in which a heating tool 80 is pressed against a distal end 95 of each of the pegs 12 at the exterior surface 74 to melt the distal end 95, forming the head portion 76. The melted end (e.g., the head portion 76) may also bond to the exterior surface 74 of the outer layer 52B when it melts, thereby bonding the pegs 12 to the exterior surface 74 of the outer layer 52B.

The method of manufacturing 200 may also include step 214, closing an opening between the inner layer and the outer layer through which the heel support device was inserted in step 202, such as by closing opening 67 between inner layer 52A and outer layer 52B. Step 214 occurs after steps 202 and 204, and may occur either before or after steps 206 and 208.

The following Clauses provide example configurations of an article of footwear, heel support device, and a method of manufacturing disclosed herein.

Clause 1: An article of footwear comprising: an upper defining apertures spaced apart from one another in a first arrangement; a footwear element having pegs spaced apart from one another in the first arrangement and extending through the apertures in the upper; and wherein the pegs are secured at a surface of the upper.

Clause 2: The article of footwear of Clause 1, wherein: the upper includes an inner layer and an outer layer, and defines a foot-receiving cavity inward of the inner layer; the apertures extend through the outer layer; the footwear element is disposed between the inner layer and the outer layer; and the inner layer is disposed between the footwear element and the foot-receiving cavity.

Clause 3: The article of footwear of Clause 1 or Clause 2, wherein: each of the pegs includes a shaft portion and a head portion of unitary, integral construction with the shaft portion; the shaft portion extends through one of the apertures of the upper; and the head portion is bonded at the surface of the upper.

Clause 4: The article of footwear of Clause 3, wherein the head portion depicts at least one of a number, a letter, a symbol, a logo, an object, or a design.

Clause 5: The article of footwear of Clause 1 or Clause 2, wherein the footwear element is a heel support device connected to a heel region of the upper and includes: a center portion, a medial portion extending forwardly from the center portion at a medial side of the heel support device, and a lateral portion extending forwardly from the center portion at a lateral side of the heel support device; wherein a first of the pegs is integral with and extends outward from the center portion, a second of the pegs is integral with and extends outward from the medial portion, and a third the pegs is integral with and extends outward from the lateral portion.

Clause 6: The article of footwear of Clause 5, wherein the heel support device, including the center portion, the medial portion, the lateral portion, and the pegs, is a unitary, one-piece component.

Clause 7: The article of footwear of Clause 5, wherein: the heel support device includes a control bar and a base; the control bar has a center segment, a medial side arm extending downwardly and forwardly from the center segment at the medial side of the heel support device, and a lateral side arm extending downwardly and forwardly from the center segment at the lateral side of the heel support device; the base has a medial base arm connected to the medial side arm of the control bar, a lateral base arm connected to the lateral side arm of the control bar, and a center segment connecting the medial base arm to the lateral base arm; and the first of the pegs extends outward from the center segment of the control bar, the second of the pegs extends outward from the medial side arm of the control bar or from the medial base arm, and a third of the pegs extends outward from the lateral side arm of the control bar or from the lateral base arm.

Clause 8: The article of footwear of Clause 7, wherein: the control bar includes a series of slats; each slat of the series of slats extends in the center segment, the medial side arm, and the lateral side arm; and the first of the pegs extends outward from one slat of the series of slats, and a fourth of the pegs extends outward from the center segment of the base.

Clause 9: The article of footwear of any of Clauses 7-8, wherein: the control bar is biased to an unloaded position and elastically bends under an applied force to a loaded position in which the control bar is closer to the base than in the unloaded position, storing potential energy that returns the control bar to the unloaded position upon removal of the applied force; the upper is connected to move with the control bar by the first of the pegs; and an ankle opening of the upper extends further rearward and downward when the control bar is in the loaded position than when the control bar is in the unloaded position.

Clause 10: A method of manufacturing an article of footwear, the method of manufacturing comprising: placing a footwear element between an inner layer of an upper and an outer layer of the upper; wherein the footwear element includes at least one peg extending outward toward the outer layer; inserting the at least one peg of the footwear element through the outer layer of the upper so that the at least one peg extends through the outer layer and is exposed at an exterior surface of the outer layer; and after inserting the at least one peg of the footwear element through the outer layer of the upper, securing the at least one peg at the exterior surface of the outer layer.

Clause 11: The method of manufacturing of Clause 10, wherein: the at least one peg includes multiple pegs, and the outer layer of the upper includes multiple apertures; the pegs are spaced apart from one another in a first arrangement; and the apertures are spaced apart from one another in the first arrangement so that the apertures align with the pegs.

Clause 12: The method of manufacturing of Clause 10, wherein securing the at least one peg at the exterior surface of the outer layer comprises bonding the at least one peg to the exterior surface of the outer layer.

Clause 13: The method of manufacturing of Clause 12, wherein bonding the at least one peg to the exterior surface of the outer layer comprises: pressing a heating tool against an end of the at least one peg at the exterior surface of the outer layer to melt the end against the exterior surface of the outer layer.

Clause 14: The method of manufacturing of Clause 13, wherein the heating tool has a mold surface that shapes a head portion of the at least one peg at the exterior surface of the outer layer, said pressing the heating tool to melt the end creates the head; and the method of manufacturing further comprising: selecting the heating tool from a group of heating tools each having a mold surface with a different shape depicting at least one of a number, a letter, a symbol, a logo, an object, or a design, or with a different surface texture.

Clause 15: The method of manufacturing of Clause 14, wherein selecting the heating tool is in response to a request for a specific shape or a specific surface texture of the head; and wherein the mold surface of the heating tool selected has the specific shape or the specific surface texture requested.

Clause 16: The method of manufacturing of any of Clauses 10-15, wherein placing the footwear element between the inner layer of the upper and the outer layer of the upper is through an opening between the inner layer and the outer layer; and the method of manufacturing further comprising: after placing the footwear element between the inner layer and the outer layer, closing the opening.

Clause 17: A heel support device for an article of footwear, the heel support device comprising: a control bar and a base, both of which are configured to surround a portion of a foot-receiving cavity at a heel region of an article of footwear; wherein the control bar has a center segment, a medial side arm extending downwardly and forwardly from the center segment at a medial side of the heel support device, and a lateral side arm extending downwardly and forwardly from the center segment at a lateral side of the heel support device; wherein the base has a medial base arm connected to the medial side arm of the control bar, a lateral base arm connected to the lateral side arm of the control bar, and a center segment connecting the medial base arm to the lateral base arm; wherein the heel support device includes pegs extending outward from the heel support device, including a first of the pegs extending outward from the center segment of the control bar, a second of the pegs extends outward from the medial side arm of the control bar or from the medial base arm, and a third of the pegs extends outward from the lateral side arm of the control bar or from the lateral base arm; and wherein the control bar is biased to an unstressed position and elastically deforms toward the base under an applied force to a loaded position, and the heel support device stores potential energy that returns the control bar to the unstressed position upon removal of the applied force.

Clause 18: The heel support device of Clause 17, wherein: the control bar includes a series of slats; each slat of the series of slats extends in the center segment, the medial side arm, and the lateral side arm; and the first of the pegs extends outward from one slat of the series of slats.

Clause 19: The heel support device of Clause 18, wherein a fourth of the pegs extends outward from the center segment of the base.

Clause 20: The heel support device of any of Clauses 16-19, wherein the heel support device, including the control bar, the base, and the pegs, is a unitary, one-piece component.

Clause 21: An article of footwear comprising: an upper comprising at least a first layer of a first material having a first melt temperature, the first layer having an inner surface facing a foot-receiving cavity formed by the upper and having an outer surface facing away from the foot-receiving cavity; a footwear element including a body and at least one peg, the at least one peg having a stem and a head, a first end of the stem joined to the body and the head disposed at a second end of the stem; wherein the body is disposed proximate to the inner surface of the first layer, and the head is disposed proximate to the outer surface of the first layer; and wherein said at least one peg comprises a second material having a second melt temperature lower than the first melt temperature.

Clause 22: The article of footwear of Clause 21, wherein the stem and the head are of unitary, integral construction, the stem also comprising the second material.

Clause 23: The article of footwear of Clause 21, wherein the head, the stem, and the body are of unitary, integral construction, the stem and the body also comprising the second material.

Clause 24: The article of footwear of Clause 21, wherein the first layer of the upper defines apertures spaced apart from one another in a first arrangement; and the at least one peg comprises multiple pegs spaced apart from one another in the first arrangement and extending through the apertures in the upper.

Clause 25: The article of footwear of Clause 24, wherein: the first layer is an outer layer of the upper, the upper further including an inner layer with the foot-receiving cavity inward of the inner layer; the apertures extend through the outer layer; the footwear element is disposed between the inner layer and the outer layer; and the inner layer is disposed between the footwear element and the foot-receiving cavity.

Clause 26: The article of footwear of Clause 25, wherein: the footwear element is a heel support device disposed at a heel region of the upper; the body comprises a center portion, a medial portion extending forwardly from the center portion at a medial side of the heel support device, and a lateral portion extending forwardly from the center portion at a lateral side of the heel support device; wherein a first of the pegs is integral with and extends outward from the center portion, a second of the pegs is integral with and extends outward from the medial portion, and a third of the pegs is integral with and extends outward from the lateral portion.

Clause 27: The article of footwear of Clause 26, wherein the heel support device, including the center portion, the medial portion, the lateral portion, and the pegs, is a unitary, one-piece component.

Clause 28: The article of footwear of Clause 25, wherein: the footwear element is a heel support device connected to a heel region of the upper; the body of the heel support device includes a control bar and a base; the control bar has a center segment, a medial side arm extending downwardly and forwardly from the center segment at a medial side of the heel support device, and a lateral side arm extending downwardly and forwardly from the center segment at a lateral side of the heel support device; the base has a medial base arm connected to the medial side arm of the control bar, a lateral base arm connected to the lateral side arm of the control bar, and a center segment connecting the medial base arm to the lateral base arm; and a first of the pegs extends outward from the center segment of the control bar, a second of the pegs extends outward from the medial side arm of the control bar or from the medial base arm, and a third of the pegs extends outward from the lateral side arm of the control bar or from the lateral base arm.

Clause 29: The article of footwear of Clause 28, wherein: the control bar includes a series of slats; each slat of the series of slats extends in the center segment, the medial side arm, and the lateral side arm; and the first of the pegs extends outward from one slat of the series of slats, and a fourth of the pegs extends outward from the center segment of the base.

Clause 30: The article of footwear of any of Clauses 28-29, wherein: the control bar is biased to an unloaded position and elastically bends under an applied force to a loaded position in which the control bar is closer to the base than in the unloaded position, storing potential energy that returns the control bar to the unloaded position upon removal of the applied force; the upper is connected to move with the control bar by the first of the pegs; and an ankle opening of the upper extends further rearward and downward when the control bar is in the loaded position than when the control bar is in the unloaded position.

Clause 31: The article of footwear of Clause 21, wherein the head depicts at least one of a number, a letter, a symbol, a logo, an object, or a design.

Clause 32: An article of footwear, comprising: an upper having at least a first layer of a pliable material disposed about at least a portion of a foot-receiving cavity; an elastically deformable structural member disposed at a first side of the first layer proximate the foot-receiving cavity; a peg extending from a first end joined with the elastically deformable structural member to a distal end spaced apart from the elastically deformable structural member; wherein: the peg extends through an aperture provided in the first layer and to a second side of the first layer; a broadened head is provided at the distal end of the peg; and a width of the broadened head is greater than a width of the aperture.

Clause 33: A method of manufacturing an article of footwear, the method of manufacturing comprising: obtaining a footwear element having a peg comprising a stem; causing the stem to extend through a first layer of an upper and protrude from the first layer; and forming a head at one end of the stem after the stem protrudes from the first layer.

Clause 34: The method of Clause 33, wherein forming the head bonds the head to the first layer.

Clause 35: The method of manufacturing of any of Clauses 33-34, wherein forming the head comprises melting the one end of the stem.

Clause 36: The method of manufacturing of any of Clauses 33-35, wherein forming the head comprises pressing a heating tool against the one end of the stem to melt the one end.

Clause 37: The method of Clause 36, wherein the heating tool has a mold surface that shapes the head, and the method of manufacturing further comprising: selecting the heating tool from a group of heating tools each having a mold surface with a different shape depicting at least one of a number, a letter, a symbol, a logo, an object, or a design, or with a different surface texture.

Clause 38: The method of manufacturing of Clause 37, wherein selecting the heating tool is in response to a request for a specific shape or a specific surface texture of the head; and wherein the mold surface of the heating tool selected has the specific shape or the specific surface texture requested.

Clause 39: The method of manufacturing of any of Clauses 33-38, wherein the head protrudes through an aperture in the first layer, and the head is larger than the aperture.

Clause 40: The method of manufacturing of any of Clauses 33-39, wherein the upper further comprises a second layer, the method further comprising: placing the footwear element between the first layer and the second layer prior to forming the head.

Clause 41: The method of manufacturing of Clause 40, wherein placing the footwear element between the first layer and the second layer of the upper is through an opening between the first layer and the second layer; and the method of manufacturing further comprising: after placing the footwear element between the first layer and the second layer, closing the opening.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. As used in the description and the accompanying claims, a value is considered to be "approximately" equal to a stated value if it is neither more than 5 percent greater than nor more than 5 percent less than the stated value. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. A method of manufacturing an article of footwear, the method of manufacturing comprising:

obtaining a footwear element having a peg comprising a stem;

causing the stem to extend through a first layer of an upper and protrude from the first layer; and forming a head at one end of the stem after the stem protrudes from the first layer;

wherein forming the head bonds the head to the first layer; and wherein forming the head comprises melting the one end of the stem.

2. A method of manufacturing of claim 1, an article of footwear, the method of manufacturing comprising:

obtaining a footwear element having a peg comprising a stem;

causing the stem to extend through a first layer of an upper and protrude from the first layer; and forming a head at one end of the stem after the stem protrudes from the first layer, wherein forming the head comprises pressing a heating tool against the one end of the stem to melt the one end.

3. The method of manufacturing of claim 2, wherein the heating tool has a mold surface that shapes the head, and the method of manufacturing further comprising:

selecting the heating tool from a group of heating tools each having a mold surface with a different shape depicting at least one of a number, a letter, a symbol, a logo, an object, or a design, or with a different surface texture.

4. The method of manufacturing of claim 3, wherein selecting the heating tool is in response to a request for a specific shape or a specific surface texture of the head; and wherein the mold surface of the heating tool selected has the specific shape or the specific surface texture requested.

5. The method of manufacturing of claim 1, wherein the head protrudes through an aperture in the first layer, and the head is larger than the aperture.

6. The method of manufacturing of claim 1, wherein the upper further comprises a second layer, the method further comprising:

placing the footwear element between the first layer and the second layer prior to forming the head.

7. The method of manufacturing of claim 6, wherein placing the footwear element between the first layer and the second layer of the upper is through an opening between the first layer and the second layer; and the method of manufacturing further comprising:

after placing the footwear element between the first layer and the second layer, closing the opening.

8. A method of manufacturing an article of footwear, the method of manufacturing comprising:

placing a footwear element between an inner layer of an upper and an outer layer of the upper; wherein the footwear element includes at least one peg extending outward toward the outer layer;

inserting the at least one peg of the footwear element through the outer layer of the upper so that the at least one peg extends through the outer layer and is exposed at an exterior surface of the outer layer; and after inserting the at least one peg of the footwear element through the outer layer of the upper, securing the at least one peg at the exterior surface of the outer layer;

wherein securing the at least one peg at the exterior surface of the outer layer comprises bonding the at least one peg to the exterior surface of the outer layer; and wherein bonding the at least one peg to the exterior surface of the outer layer comprises pressing a heating tool against an end of the at least one peg at the exterior surface of the outer layer to melt the end against the exterior surface of the outer layer.

9. The method of manufacturing of claim 8, wherein:

the at least one peg includes multiple pegs, and the outer layer of the upper includes multiple apertures;

the pegs are spaced apart from one another in a first arrangement; and the apertures are spaced apart from one another in the first arrangement so that the apertures align with the pegs.

10. The method of manufacturing of claim 8, wherein the heating tool has a mold surface that shapes a head portion of the at least one peg at the exterior surface of the outer layer, said pressing the heating tool to melt the end creates the head portion; and the method of manufacturing further comprising:

selecting the heating tool from a group of heating tools each having a mold surface with a different shape depicting at least one of a number, a letter, a symbol, a logo, an object, or a design, or with a different surface texture.

11. The method of manufacturing of claim 10, wherein selecting the heating tool is in response to a request for a specific shape or a specific surface texture of the head portion; and wherein the mold surface of the heating tool selected has the specific shape or the specific surface texture requested.

12. The method of manufacturing of any of claim 8, wherein placing the footwear element between the inner layer of the upper and the outer layer of the upper is through an opening between the inner layer and the outer layer; and the method of manufacturing further comprising:

after placing the footwear element between the inner layer and the outer layer, closing the opening.

* * * * *